US005228840A

United States Patent [19]

Swank

[11] Patent Number: 5,228,840

[45] Date of Patent: Jul. 20, 1993

[54] POSITIVE DISPLACEMENT PUMPS

[75] Inventor: Robert P. Swank, Bellville, Ohio

[73] Assignee: Impact MST Incorporated, Cincinnati, Ohio

[21] Appl. No.: 637,602

[22] Filed: Jan. 2, 1991

Related U.S. Application Data

[63] Continuation-in-part of Ser. No. 271,166, Nov. 14, 1988, Pat. No. 4,990,062.

[51] Int. Cl.[5] ..... F04B 19/00

[52] U.S. Cl. ..... 417/211; 417/240; 417/118; 417/140

[58] Field of Search ..... 417/118, 137, 140, 572, 417/437, 240, 241, 211

[56] References Cited

U.S. PATENT DOCUMENTS

| | | | |
|---|---|---|---|
| Re. 29,055 | 11/1976 | Wagner | 417/388 |
| 107,426 | 9/1870 | Vater | 417/137 |
| 367,803 | 8/1887 | Freiner | 417/137 |
| 901,344 | 10/1908 | Horstmann | 417/328 |
| 1,511,985 | 10/1924 | Spencer | 225/51 |
| 1,658,705 | 2/1928 | Caproni | 417/273 |
| 2,019,023 | 10/1935 | Seilliere | 417/368 |
| 2,052,472 | 8/1936 | Hyman | 91/6.5 |
| 2,083,847 | 6/1945 | Johnson | 417/462 |
| 2,392,279 | 1/1946 | Woods | 91/180 |
| 2,578,746 | 12/1951 | Scherger et al. | 417/388 |
| 3,019,772 | 2/1962 | Humphrey | 91/180 |
| 3,075,468 | 1/1963 | Eifel | 417/388 |
| 3,280,703 | 10/1966 | Humphrey | 91/180 |
| 3,465,684 | 9/1969 | Moll | 417/387 |
| 3,494,394 | 2/1970 | Hetz | 417/387 |
| 3,601,508 | 8/1971 | Orlita | 417/388 |
| 3,680,981 | 8/1972 | Wagner | 417/388 |
| 4,106,443 | 8/1978 | Triulzi | 417/462 |
| 4,169,433 | 10/1979 | Crocker | 417/328 |
| 4,347,778 | 9/1982 | Murray | 91/180 |
| 4,365,940 | 12/1982 | Hosokawa | 417/269 |
| 4,371,323 | 1/1983 | Fischer et al. | 418/55.3 |
| 4,541,781 | 9/1985 | Sheffer | 417/211 |
| 4,690,620 | 9/1987 | Eickmann | 417/273 |

FOREIGN PATENT DOCUMENTS

| | | | |
|---|---|---|---|
| 0536323 | 1/1977 | U.S.S.R. . | |
| 1270413 | 11/1986 | U.S.S.R. | 417/211 |

*Primary Examiner*—Richard A. Bertsch
*Assistant Examiner*—Peter Korytnyk
*Attorney, Agent, or Firm*—Wood, Herron & Evans

[57] ABSTRACT

A positive displacement pump comprises a mass such as a liquid filled pressure chamber or an annular ring which is rotated at high speed about a first axis so that centrifugal force acting on the liquid or ring creates zones of differential pressure within the interior of the pressure chamber or along the wall of the ring. At least one pumping unit having a pressure-responsive member is oscillated or rotated between the zones of differential pressure while the center of gravity of the pressure chamber or ring is maintained at a fixed distance from the first axis. In the course of moving into one zone having one pressure, the pressure-responsive member of the pumping unit is effective to intake a fluid such as air into the pumping unit. Air is discharged from the pumping unit by the pressure-responsive member in the course of moving from such one zone into another zone having a different pressure.

32 Claims, 15 Drawing Sheets

POSITIVE DISPLACEMENT PUMPS

This is a continuation-in-part application of U.S. patent application Ser. No. 07/271,166, filed Nov. 14, 1988 now U.S. Pat. No. 4,990,062 and entitled "Positive Displacement Pumps".

FIELD OF THE INVENTION

This invention relates to positive displacement pumps, and, more particularly, to a centrifugal force type positive displacement pump in which at least one pumping unit having a pressure-responsive, intake and exhaust member is movable between zones or regions of differential fluid pressure formed by centrifugal force such that the intake and exhaust member of each pumping unit intakes and exhausts air or other fluid in moving between such zones.

BACKGROUND OF THE INVENTION

Positive displacement pumps are characterized by alternately filling and emptying an enclosed volume by the operation of a mechanism such as a reciprocating piston, meshing gears, sliding vanes, screws, etc. The pumping mechanism, for example, a reciprocating piston, is movable within an enclosed chamber between an intake position in which negative pressure is created within the chamber to draw fluid therein, and an exhaust position in which the fluid drawn into the chamber is pressurized and/or exhausted through an outlet in the chamber. In many instances, the pumping mechanism is driven by an electric motor through a crank, or, alternatively, the driving force for the pumping mechanism can be direct acting such as by steam or compressed air.

Positive displacement pumps of the type described above have a number of limitations, particularly for certain types of applications. One problem is that the operation of the pumping mechanisms is relatively loud. Reciprocating pistons or plungers, even if well lubricated, are relatively noisy when sliding within an enclosed chamber. Similarly, the pumping mechanisms associated with rotary-type displacement pumps, e.g., meshing gears, sliding vanes or screws, are also relatively noisy due to the metal-to-metal engagement of their moving parts.

A second problem with positive displacement pumps such as described above is that the pumping mechanisms and associated bearings must be lubricated to reduce wear and ensure smooth operation of the pump. As a result, the fluid being pumped comes into contact with the lubricated surfaces of the pumping mechanisms and can pick up contaminants. This is unacceptable where the air or other fluid being pumped must be clean such as in the pumping of oxygen into oxygen tents and similar applications in hospitals or other health care facilities. It is also important for pumps utilized in hospitals to operate quietly, and vibration-free, which is another deficiency of prior art positive displacement pumps.

A third problem with prior art positive displacement pumps is their limited capability to dissipate heat generated by the moving parts. Particularly at high operating speeds, the compression of the air being pumped, and the metal-to-metal contact between the pumping mechanisms, e.g., reciprocating pistons, meshing gears, etc., generates heat which is relatively slowly dissipated from such working parts through the walls of the enclosed chamber. After a period of operation, the temperature of the interior of the chamber may increase substantially leading to damage of the pump.

Another problem with prior art positive displacement pumps involves restarting the pump after it has been operated for a period of time and then shut down. Under these circumstances, the lines between the pump and fluid supply remain pressurized and make it difficult to initially move the pumping mechanism, e.g., a reciprocating piston, to overcome such "dead-head" or back pressure. This problem has been solved in the prior art by incorporating a bleeder valve or other pressure relief device between the pump and fluid supply to eliminate back pressure, but such devices add to the cost and complexity of the pumping system.

Another type of positive displacement pump has been proposed in the prior art which is shown, for example, in U.S. Pat. Nos. 901,344 to Horstmann; 1,511,985 to Spencer; 3,465,684 to Moll; and, 4,169,433 to Crocker. These pumps employ a "floating" piston which is freely movable within a cylinder having an inlet and an outlet. Movement of the piston within the cylinder in one direction creates a negative pressure therein which draws air through the inlet into the cylinder. Movement of the piston in the opposite direction forces the fluid through the outlet of the cylinder to create a pumping action.

Movement of the floating piston within the cylinder is caused by rotating the cylinder and piston about a first axis so that centrifugal force is applied to the piston, and at the same time rotating the cylinder about an axis passing through its midpoint so that the ends of the cylinder change position relative to the first axis. With the ends of the cylinder in one position, the piston is thrown radially outwardly toward one end of the cylinder by centrifugal force, and this movement either intakes or exhausts fluid from the cylinder. The cylinder is then rotated about its midpoint so that its ends switch position, which, in turn, causes the piston to be moved by centrifugal force to the opposite end of the cylinder.

One problem with centrifugal force, positive displacement pumps of the type described above is that a high amount of energy is required to rotate the cylinder about its midpoint in order to move the piston from one end of the cylinder to the other. Each time the piston changes position within the cylinder, the center of gravity of the cylinder and piston unit changes. Substantial power is required to change this center of gravity, i.e., to overcome centrifugal force and cause the piston to shift from one end of the cylinder to the other. This problem is made even worse when the cylinder and piston are rotated at high speeds in order to increase the pumping rate of the pump. The higher the speed of rotation the higher the centrifugal force applied to the piston, which, in turn, requires more energy to rotate the cylinder about its midpoint and shift the position of the piston therewithin.

Centrifugal-type, positive displacement pumps also share many of the deficiencies of standard positive displacement pumps. They are relatively noisy where the floating piston is allowed to contact the ends of the cylinder, and the fluid being pumped is exposed to and can be contaminated by the lubricant which permits movement of the piston within the cylinder.

SUMMARY OF THE INVENTION

It is therefore among the objectives of this invention to provide a centrifugal force-actuated positive displacement pump which is quiet and vibration-free in operation, which pumps fluid free of any contaminants, which effectively dissipates heat produced by operation of the pump, which requires minimal energy to operate even at high speeds, which is economical to manufacture and which is highly efficient.

These objectives are accomplished in a positive displacement pump which comprises a mass rotatable relative to a first axis so that centrifugal force acts on the mass to create zones of higher pressure and lower pressure and/or higher and lower force at different distances from the first axis. A number of pumping units associated with the movable mass are rotatable relative to a second axis such that the pumping units pass through the zones of higher and lower pressure. Each pumping unit has a pressure-responsive intake and exhaust member which is effective to either intake fluid into the pumping unit or exhaust fluid therefrom in the course of moving between the zones of higher and lower pressure or force.

The centrifugal force-type, positive displacement pump of this invention is predicated upon the concept of creating differential pressure zones by the rotation of a mass at a fixed distance relative to a first axis, and then moving a pumping unit having a plurality of pressure-responsive intake and exhaust members through such pressure zones to intake and then exhaust fluid. The "movable mass" which is subjected to centrifugal force to create differing pressure zones can take the form of a body of liquid or semi-liquid material which fills or partially fills a pressure chamber, or, alternatively, a ring formed of metal or a similar relatively heavy, dense material and having a wall formed with an inner and outer surface. The pressure chamber containing the liquid mass, or ring, are rotated about a first axis so that centrifugal force acts on the mass to create zones of differing fluid pressure within the interior of the pressure chamber or at different locations along the wall of the ring. These pressure zones vary in pressure or force as the radial distance from the first axis varies. While the center of gravity of the liquid mass within the pressure chamber and the center of gravity of the ring each remain in a fixed position relative to the first axis, the intake and exhaust members of the pumping units are oscillated or rotated between these differing pressure zones to intake and exhaust fluid from the pumping units.

For example, in one presently preferred embodiment of this invention, a cylindrical-shaped pressure chamber is substantially completely filled with a liquid such as water except for a plurality of pumping units carried within the interior of the pressure chamber. Each pumping unit includes an intake and exhaust means, i.e., a flexible cylindrical tube mounted at the inner wall of the pressure chamber having one end connected to an air inlet passageway covered by a first, one-way flapper valve and an opposite end connected to an air outlet passageway covered by a second, one-way flapper valve. The outlet passageways of the pumping units are connected to a common outlet formed in the pressure chamber.

The pressure chamber is rotated by a high speed shaft so that the water or other fluid therein is acted upon by centrifugal force. The centrifugal force within the pressure chamber increases as the radial distance from the axis of the high speed shaft increases. This produces zones of different fluid pressure within the body of water in the pressure chamber wherein a zone or area of the pressure chamber located closest to the high speed shaft is at the lowest fluid pressure, and a zone or area of the pressure chamber furthest from the high shaft is at the highest fluid high pressure.

The cylindrical pressure chamber is connected to a second, low speed shaft which is radially spaced from and parallel to the high speed shaft. The low speed shaft is operable to rotate the pressure chamber about its axis at the same time the high speed shaft rotates the pressure chamber. As a result of the rotation of the low speed shaft, the flexible cylindrical tubes of each pumping unit carried on the inner wall of the pressure chamber are moved through the zones of differing fluid pressure within the pressure chamber.

Preferably, the flexible cylindrical tube of each pumping unit is effective to expand to its largest diameter in an area or zone of lowest fluid pressure within the pressure chamber. That is, as each flexible cylindrical tube of a pumping unit is rotated by the low speed shaft from a highest fluid pressure zone to a lowest fluid pressure zone radially close to the high speed shaft, the flexible cylindrical tube expands to its largest diameter. This expansion of the flexible cylindrical tube draws or sucks air into the inlet passageway of the pumping unit which opens the flapper valve and fills the tube with air or another fluid. The air-filled, flexible cylindrical tube is then rotated by the low speed shaft from the zone of lowest pressure into the zone of highest pressure within the pressure chamber which is furthest from the axis of the high speed shaft. In moving to such zone of highest pressure within the pressure chamber, the walls of the flexible cylindrical tube are squeezed together thus forcing the air contained therein through the discharge passageway of the pumping unit and out the common outlet in the pressure chamber.

Each pressure-responsive, flexible cylindrical tube of a pumping unit is therefore effective to alternately expand and intake air in moving toward a zone of lowest fluid pressure within the pressure chamber, and then contract to exhaust such air in moving from a lowest pressure zone to a zone of highest fluid pressure within the pressure chamber.

Alternative embodiments of this invention are disclosed which also operate with a liquid or semi-liquid filled pressure chamber. For example, in one alternative embodiment of this invention, a pressure chamber is connected to a high speed shaft which is operable to rotate the pressure chamber with respect to the axis of the shaft. The pressure chamber is also connected to a hollow, low speed shaft which is operable to rotate the pressure chamber about an axis substantially perpendicular to the axis of the high speed shaft. The pressure chamber is substantially filled with fluid such as water and this fluid is subjected to centrifugal force by the rotation of the high speed shaft forming zones within the pressure chamber which increase in pressure as the radial distance from the axis of the high speed shaft increases.

A number of pumping units are spaced about the inner periphery of the pressure chamber of this second embodiment, each of which comprises a base formed with a generally cup-shaped surface whose outer, peripheral edge mounts a pressure-responsive, flexible membrane. The base of each pumping unit has an air inlet passageway connected to an opening in the wall of the pressure chamber, and an outlet passageway which is connected by a tube to the hollow center of the low speed shaft. Both the inlet and outlet passageways are covered by one-way flapper valves.

In this embodiment, each of the pumping units are effective to intake air from atmosphere in moving from a zone of highest fluid pressure spaced furthest from the high speed shaft to a position parallel to the axis of the high speed shaft, i.e., to a zone within the pressure chamber where the centrifugal force, and thus the fluid pressure, is lowest. In moving to this position, the flexible membrane or intake and exhaust means of each pumping unit is expanded outwardly relative to the cup-shaped surface of the base to create a suction therebetween which intakes air into a chamber formed between the flexible membrane and the base. As the pumping units are rotated by the low speed shaft from a zone of lowest fluid pressure to a zone of highest fluid pressure within the pressure chamber, radially spaced from the axis of the high speed shaft, the flexible membrane is progressively forced against the cup-shaped surface which, in turn, forces the air therebetween through the outlet passageway in the base and into the outlet tube for discharge through the low speed shaft.

A third embodiment of this invention is provided which operates upon the same principle as the previously described embodiments except with a pressure chamber and pumping units having a different construction. In this embodiment, a pressure chamber substantially filled with a liquid or semi-liquid material is rotatable about the axis of a high speed shaft connected thereto. A hollow, low speed shaft mounts a number of pumping units within the interior of the pressure chamber. Each of the pumping units includes a hollow arm extending radially outwardly from the low speed shaft having a cup-shaped outer end formed with a peripheral edge which mounts a pressure-responsive, flexible membrane. The low speed shaft rotates the arm of each pumping unit about an axis perpendicular to the axis of the high speed shaft so that the outer end of each arm passes through zones of differing fluid pressure created in the body of liquid or semi-liquid within the pressure chamber. As in the previous embodiments, these zones of different fluid pressure are formed within the liquid mass in the pressure chamber by rotation of the pressure chamber relative to the high speed shaft.

In this third embodiment, the flexible membrane at the end of the arm of each pumping unit progressively moves to an expanded position in moving from a zone of highest fluid pressure to a zone of lowest fluid pressure within the pressure chamber. Such expansion of the flexible membrane creates a suction at the cup-shaped end of the arm which draws air into an inlet passageway formed in the arm, past a one-way flapper valve and into a chamber formed between the cup-shaped end of the arm and the flexible membrane. As the arm of each pumping unit is moved from a zone of lowest fluid pressure to a zone within the pressure chamber of highest fluid pressure, the flexible membrane is progressively forced into contact with the cup-shaped end of such arm which exhausts the air through an outlet passageway formed in the hollow arm, past a second one-way flapper valve and into the hollow low speed shaft.

In a still further embodiment of this invention, a liquid mass carried within a pressure chamber is employed as in the previous embodiments, except the liquid mass only partially fills the pressure chamber instead of substantially completely filling it. In response to the application of centrifugal force to the liquid mass by rotation of the pressure chamber about a first axis, the liquid mass is thrown radially outwardly against the wall of the pressure chamber leaving an air cavity within the pressure chamber between the boundary of the liquid mass and the axis of rotation. This creates at least one zone of greater pressure within the liquid mass at the wall of the chamber, and at least one other zone of lesser pressure within the air cavity.

A pumping unit is located within the interior of the pressure chamber of this embodiment which comprises a central hub, an outer ring formed with a plurality of apertures and a web interconnecting the hub and ring which is formed with a separate internal passage for each aperture. The pumping unit is rotated about a second axis, oriented substantially perpendicular to the first axis, such that the apertures in the ring are sequentially moved from the air cavity at the center of the pressure chamber radially outwardly into the liquid mass at the wall of the chamber. Within the air cavity, each aperture receives air which is then carried by rotation of the ring toward the liquid mass. Sealing plates are provided at the interface between the air cavity and liquid mass so that in the course of passage of each aperture in the ring from the air cavity into the liquid mass the air within each aperture is retained therein and not permitted to escape. The air within each aperture is pressurized within the zone of higher pressure formed by the liquid mass, and such pressurized air is directed through each passage within the web from the outer ring to the central hub of the pumping unit. The flow rate of air being pumped depends upon the speed of rotation of the pumping unit and the air pressure is dependant upon the speed of rotation of the pressure chamber and, in turn, the centrifugal force exerted on the liquid mass.

In an alternative embodiment employing the above-described, partially filled pressure chamber, the pumping unit is modified and additional structure is provided to recirculate liquid which may be carried from the liquid mass at the wall of the pressure chamber into the air cavity. In this embodiment, the pumping unit comprises a cup-shaped member formed with a plurality of circumferentially spaced recesses movable between the air cavity at the center of the chamber and the liquid masses at the outer walls of the chamber. Opposed sealing members engage and seal the recesses as they pass between the air cavity and liquid bodies to retain air therein which is pressurized within the liquid bodies and directed through a flow passage formed in the cup-shaped member of the pumping unit. Liquid or semi-liquid material carried out of the liquid bodies in the form of a foam by movement of the pumping unit therethrough is returned into the chamber interior by a reservoir and suction device. The reservoir is formed in a frame which supports the pressure chamber and communicates with its interior. The suction device transfers collected liquid from the reservoir through a tube and then back into the interior of the pressure chamber where it flows back into the liquid bodies.

The centrifugal force, positive displacement pumps of this invention are each predicated upon a concept of creating differential pressure zones by the rotation of a mass at a fixed distance relative to a first axis, and then moving a plurality of pumping units having pressure-responsive, intake and exhaust members through such pressure zones to intake and then exhaust fluid. In each of the four embodiments described above, the movable mass comprises a liquid or semi-liquid material which completely or partially fills the pressure chamber. In alternative embodiments of this invention, the liquid or semi-liquid filled or partially filled pressure chamber is eliminated and replaced with a ring formed of a relatively heavy, dense material such as metal having a wall with an inner and outer surface. The ring is subjected to centrifugal force upon rotation about a first axis forming zones of differing pressure or force along the ring at different distances from the first axis. Pumping units are movable against the inner or outer surface of the ring wall between the zones of differing pressure to either intake or exhaust fluid therefrom.

In one presently preferred embodiment, a pump housing is formed with four annular pumping chambers, spaced 90° apart, each having a piston movable therein. The pistons located at 180° intervals from one another are connected by brackets so that as one piston moves in a first direction, the other piston connected thereto is pulled in the same direction. An annular ring is formed with a wall having an inner surface in abutment with a hub and an outer surface which faces the piston of each of the four pumping units. In response to rotation of the ring and pumping units relative to a first axis, the ring is thrown outwardly against the hub forming an area of highest pressure and an area of lowest pressure therealong.

The pumping units are rotated with respect to the ring between the zones of highest and lowest pressure. In the course of moving from the zone of lowest pressure to the zone of highest pressure, the piston of each pumping unit contacts the outer surface of the ring and is moved to a retracted position wherein air or other fluid within the pressure chamber of the pumping unit is discharged therefrom. As each pumping unit then moves from the zone or area of highest pressure to the zone of lowest pressure, the piston is moved to an extended position wherein air is drawn into the pressure chamber of the pumping unit. The pistons of pumping units located 180° apart move together as a unit so that as one pumping unit is being filled with air, the opposite pumping unit is being discharged of air.

In an alternative embodiment of this invention employing a relatively heavy ring in place of a liquid filled chamber, four or more pumping units are movable along the inner surface of the wall of a ring between areas of highest and lowest pressure produced by rotating the ring about a first axis. Each pumping unit comprises a piston which is movable within a pressure chamber between an extended position in which the pressure chamber is at maximum volume to intake air therein, and a retracted position in which all of the air within the pressure chamber is discharged therefrom. Each piston is provided with a roller or similar element engageable with the inner surface of the ring so that in the course of moving along the ring from the zone of lowest pressure to the zone of highest pressure, the piston is forced into a retracted position within the pressure chamber to compress air therein and discharge the air at the zone of highest pressure. A spring or similar element forces the piston back to an extended position as the pumping units move along the ring from the zone of highest pressure toward the zone of lowest pressure so that air is drawn into the pumping chamber of the pumping unit at the zone of lowest pressure for subsequent discharge.

Each of the embodiments of this invention have several advantages over prior art positive displacement pumps. In each embodiment, the pumping operation is performed with minimal noise. The orbital rotation, and rotation of the pumping units between the zones of different pressure, are both obtained by a quiet electric motor. Additionally, little or no vibration is produced during operation of the pumping units.

A second advantage of this invention is that the air or other fluid being pumped or withdrawn from a container is not exposed to any contaminants in the course of passage through the pump. Ambient air or other fluid drawn into the pumping units, or fluid drawn from a container if the pump is used as a vacuum pump, is exposed only to the interior of the pumping unit carried within the fluid-filled pressure chamber or brought into contact with a surface of the ring. No bearings, moving pistons, gear teeth, etc. are exposed to the working fluid in this invention. This feature of the instant invention is particularly advantageous in applications such as the pumping of air in a hospital environment where clean air must be provided to the patient.

Another advantage of this invention over floating piston-type positive displacement pumps, is that relatively little energy is required to rotate the pressure chamber and/or pumping units. In the embodiments employing pressure chambers which are partially or substantially completely filled with a liquid or semi-liquid material, the center of gravity of the pressure chamber remains substantially constant regardless of the speed of operation of a pump. Similarly, the embodiments of this invention which incorporate a weighted ring and uniformly spaced pumping units have a constant center of gravity because the ring is maintained at a fixed distance from the axis around which it orbits throughout operation of the pump. Floating piston-type centrifugal pumps, on the other hand, have a constantly changing center of gravity as described above.

A still further advantage of the positive displacement pump herein employing a pressure chamber filled or partially filled with liquid or semi-liquid material is that any heat generated by compression of the fluid being pumped, movement of the flexible membranes associated with the pumping units or any other moving parts, is readily dissipated through the fluid in the pressure chamber within which the pumping units are immersed. Such heat passes from the pumping units, through the liquid within the pressure chamber and then to the outer wall of the pump to atmosphere. This efficient dissipation of heat lessens the temperature of the pump even at relatively high operating speeds.

Another advantage of this invention is that dead-head pressure is eliminated, i.e., the back pressure created by the working fluid remaining between the pump and feed lines in prior art pumps. As mentioned above, dead-head or back pressure is exerted against a piston by pressurized fluid remaining in the cylinder and lines leading therefrom to the source of fluid being pumped. This back pressure makes it difficult to initially move the piston and start the pump without the addition of relatively expensive pressure relief devices to the system. This problem is eliminated in the instant invention because once the orbital motion of the pressure chamber or weight ring stops, the entire system depressurizes. Each of the pumping units goes to ambient pressure when the orbital motion of the pumps stop, and the pumping units are not pressurized again until the pressure chamber or weight ring are subjected to centrifugal force.

Still another advantage of the liquid filled or partially filled pressure chamber embodiments of this invention is that because the pressure-responsive members of the pumping units are fluid activated, they can be completely displaced against the seat of the pumping unit or their own wall. That is, the flexible membrane forming the pressure-responsive member can be forced into contact with the base or seat of the pumping unit without damaging the membrane. Similarly, the tube-shaped pressure-responsive members of an alternative embodiment described above can be squeezed completely together and then return to their original shape. This provides a higher compression ratio or higher vacuum potential than can be obtained with prior art pumps such as piston pumps wherein the reciprocating piston must be restrained from contacting the walls of the cylinder to avoid lock-up of the piston. Moreover, the flexible membranes forming the pressure-responsive members of the pumping units herein are subjected to uniform pressure across their entire surface area when forced against a seat or squeezed together which reduces wear and avoids localized failure.

DESCRIPTION OF THE DRAWINGS

The structure, operation and advantages of the presently preferred embodiment of this invention will become further apparent upon consideration of the following description taken in conjunction with the accompanying drawings, wherein.

DETAILED DESCRIPTION OF THE INVENTION

Figure 1:
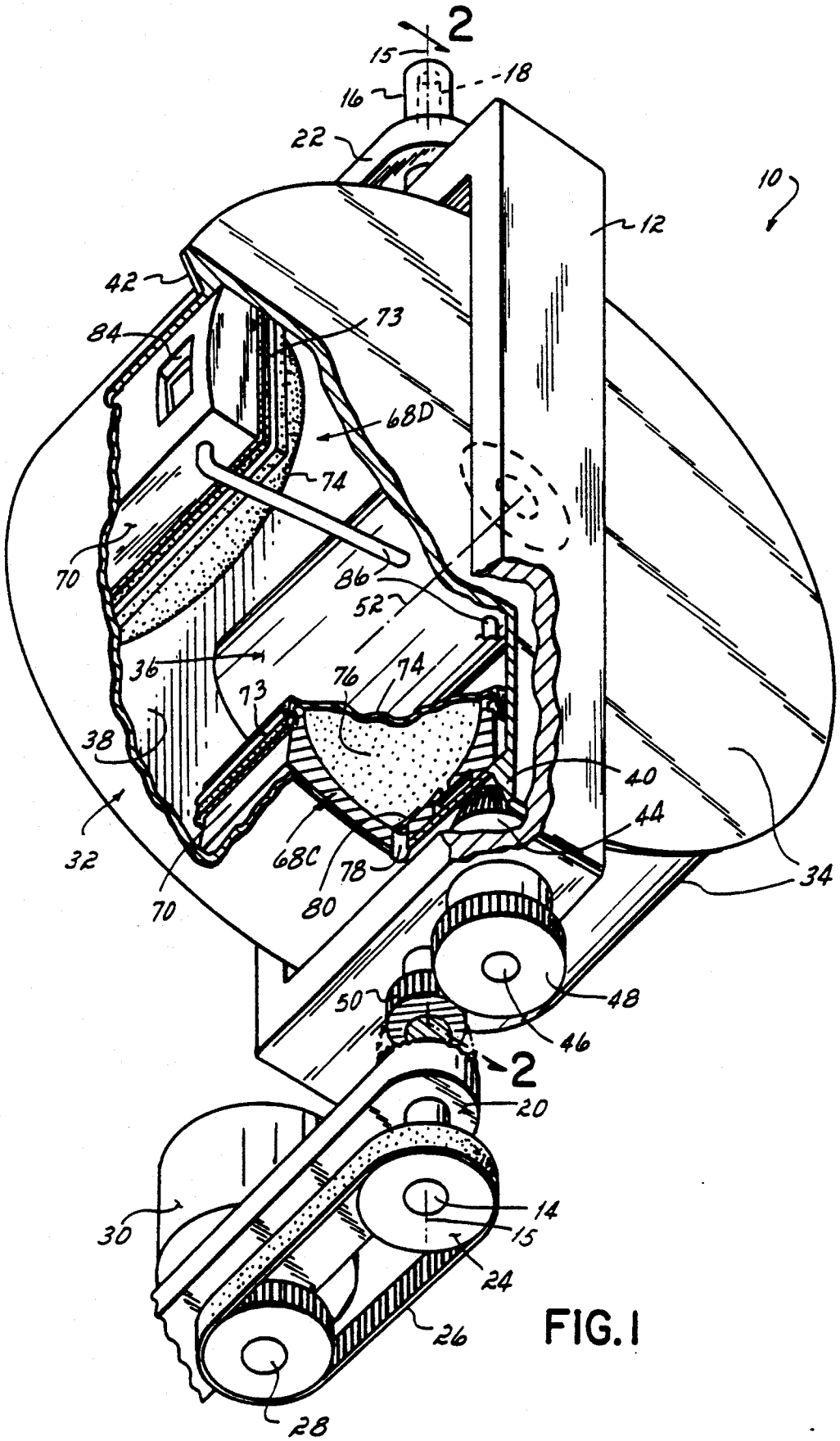
FIG. 1 is a partially broken away, perspective view of one embodiment of this invention.
Figure 2:
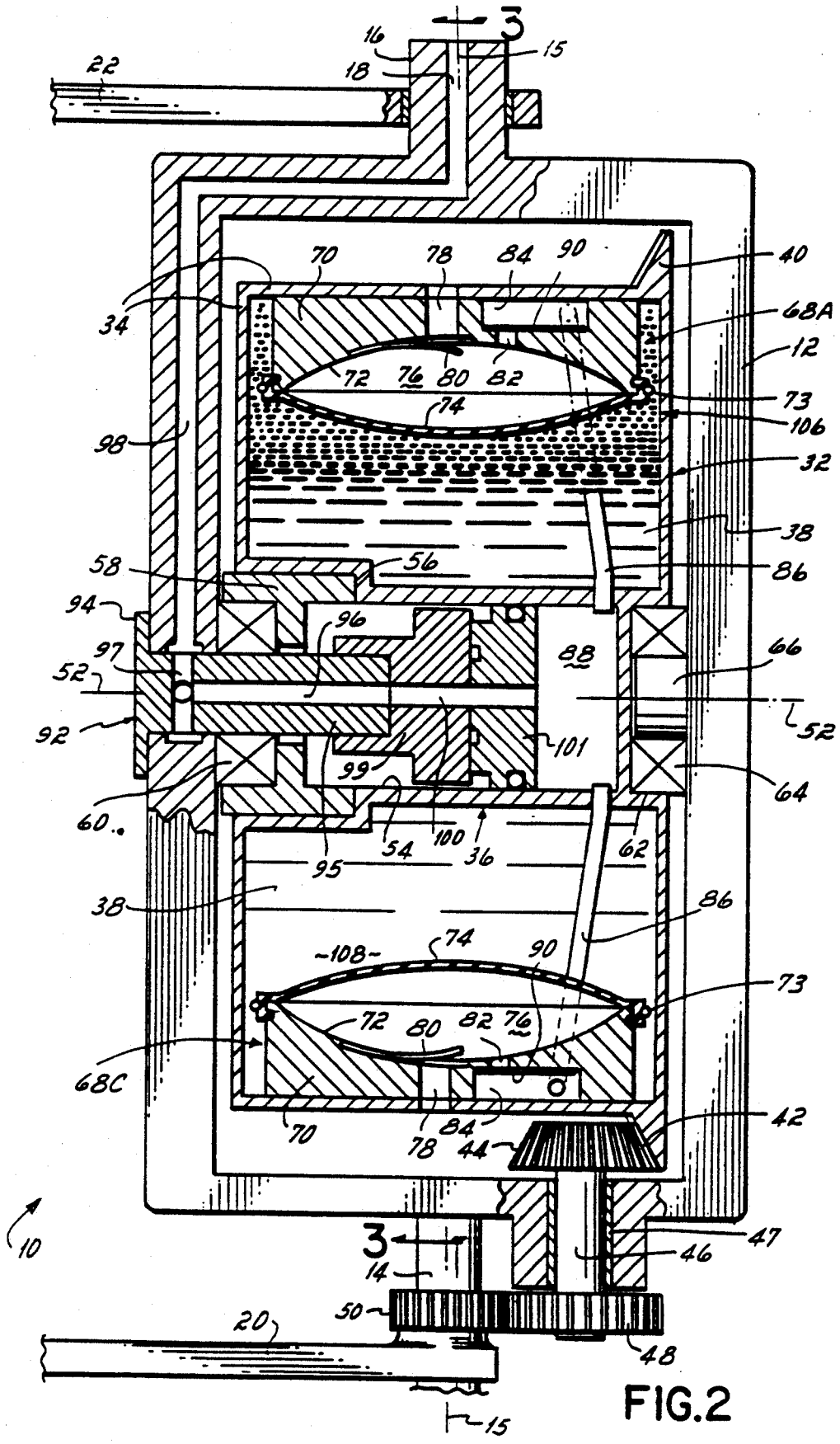
FIG. 2 is a cross sectional view taken generally along line 2—2 of FIG. 1 illustrating two of the pumping units.
Figure 3:
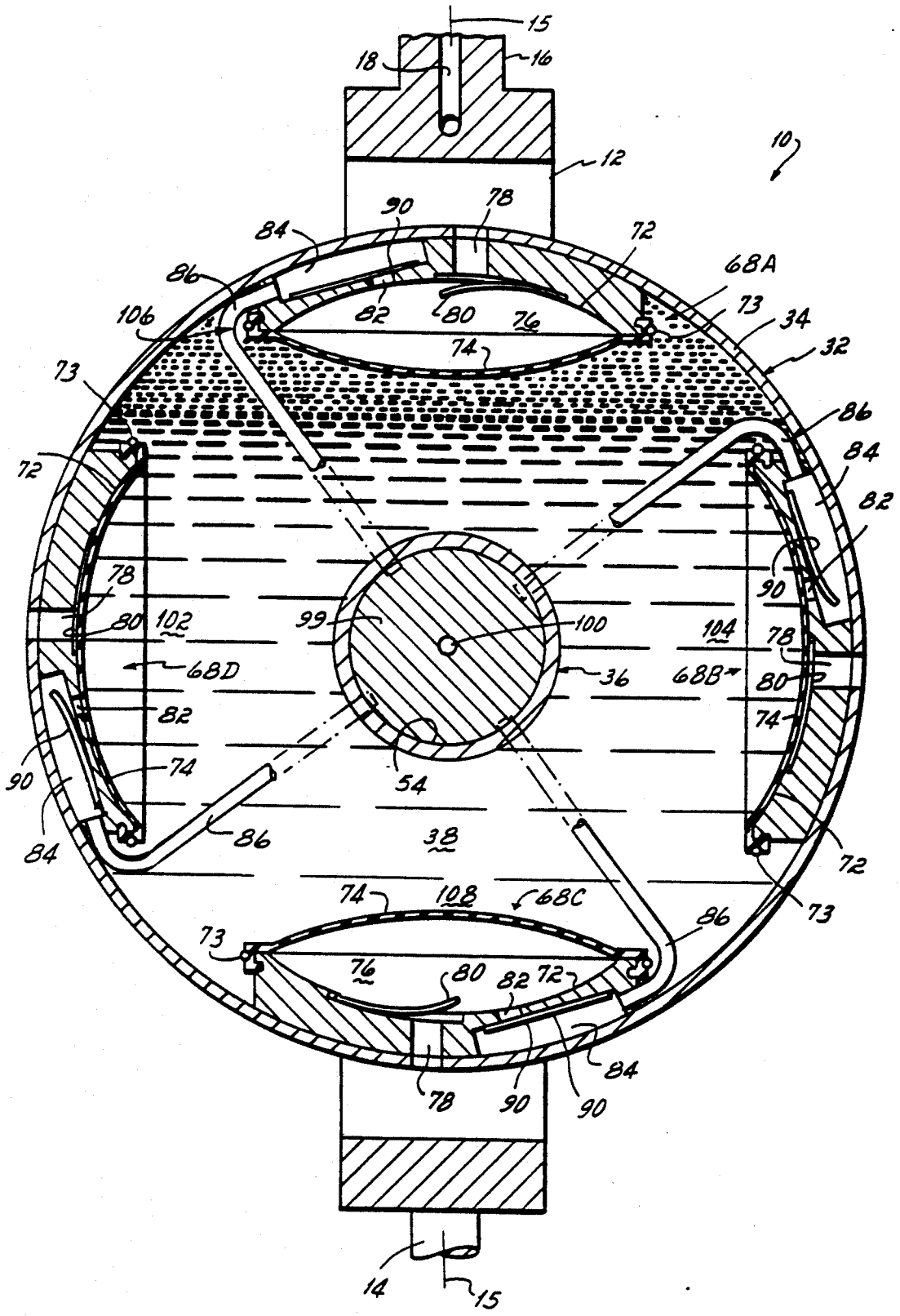
FIG. 3 is a cross sectional view taken generally along line 3—3 of FIG. 2 showing the interior of the pressure chamber and all of the pumping units.

Referring now to FIGS. 1-3, one embodiment of a centrifugal force-type, positive displacement pump 10 is illustrated. Pump 10 comprises an outer, rectangular-shaped support frame 12 having a high speed shaft 14 fixedly mounted at one end and a cylindrical extension 16 connected at the opposite end formed with a discharge passageway 18. The support frame 12 is mounted to a surface, e.g., a table or the like, by a yoke including a pair of mounting brackets 20, 22 rotatably mounted to the high speed shaft 14 and extension 16, respectively.

As best shown in FIG. 1, the outer end of high speed shaft 14 mounts a pulley 24 which is connected by a drive belt 26 to the output shaft 28 of an electric motor 30. The motor 30 is operable to drive the drive belt 26, which, in turn, rotates the support frame 12 about the longitudinal axis 15 of high speed shaft 14. Alternatively, the pulley 24 can be connected directly to the output of motor 30.

The support frame 12 mounts a pressure chamber 32 having a generally cylindrical-shaped wall 34 and a central hub 36 which together define a closed, hollow interior 38. In the presently preferred embodiment, the interior 38 of the pressure chamber 32 is filled with a liquid such as water. It is contemplated, however, that other liquids could be utilized or even "semi-liquids" such as a suspension consisting of oil and tiny ball bearings. As described in more detail below, the specific gravity of the fluid to be pumped must be less than the specific gravity of the fluid which fills the interior 38 of pressure chamber 32. Whereas a water-filled pressure chamber is suitable for pumping a gas, a heavier or higher specific gravity fluid such as oil or a "semi-liquid", liquid-solid suspension might be utilized to pump a liquid.

One end of the pressure chamber 32 is formed with an annular-shaped, beveled flange 40 having gear teeth 42 which extend circumferentially about the beveled flange 40. These gear teeth 42 mate with a bevel gear 44 mounted at one end of a stub shaft 46 which is carried in a journal 47 in the wall of support frame 12. The opposite, outer end of the stub shaft 46 mounts a follower gear 48 which meshes with a stationary sun gear 50 journalled on the high speed shaft 14 and fixedly mounted to the mounting bracket 20. As discussed in more detail below, rotation of the stub shaft 46 and bevel gear 44 causes the pressure chamber 32 to rotate about a transverse axis 52 perpendicular to the longitudinal axis 15. This transverse axis 52 passes through the central hub 36 of pressure chamber 32. It should be understood that while bevel gears 40, 44 are illustrated in the FIGS., alternative drives such as a friction drive or a belt and worm gear could be employed to rotate the pressure chamber 32.

The central hub 36 is formed with a stepped bore 54 forming a seat 56 at one end which supports a bearing mount 58. The bearing mount 58 carries a bearing 60 which extends to the inner face of the support frame 12. The opposite end of the central hub 36, as viewed in FIG. 2, is also formed with a seat 62 which mounts a bearing 64 carried on a rod 66 fixedly connected to the support frame 12. These bearings 60, 64 on opposite ends of the central hub 36 permit rotation of the pressure chamber 32 with respect to the support frame 12 about the transverse axis 52 of the central hub 36.

Referring to FIGS. 2 and 3, four pumping units 68A-D are mounted at 90° intervals along the inner surface of the wall 34 within the interior 38 of pressure chamber 32. The hollow interior 38 of pressure chamber 32 is entirely filled with a fluid such as water except for the areas occupied by pumping units 68A-D. Each pumping unit 68A-D is identical and the same reference numbers are in the FIGS. to identify like parts of each pumping unit 68A-D.

Pumping unit 68A, for example, comprises a seat or base 70 mounted to the inner surface of the wall 34 of pressure chamber 32 which is formed with a cup-shaped face 72 extending radially inwardly from the outer wall 34 of pressure chamber 32. A flexible membrane 74, i.e., an intake and exhaust means, is mounted over the peripheral edge of the cup-shaped face 72 by a clip 73 forming a chamber 76 therebetween. An air inlet 78 is formed in the base 70 which extends through an opening in the wall 34 of pressure chamber 32 to atmosphere. The air inlet 78 is covered by a one-way valve such as a flapper valve 80 which mounts to the cup-shaped face 72 of base 70 and is movable radially inwardly toward the central hub 36 of pressure chamber 32 as viewed in the FIGS.

The base 70 of pumping unit 68A is also formed with an air outlet 82 which extends from the cup-shaped face 72 radially outwardly to a recess 84 formed in the base 70 at the outer wall 34 of pressure chamber 32. This recess 84 is connected to an outlet tube 86 which extends from the base 70 into an outlet chamber 88 formed in the central hub 36 of pressure chamber 32. See FIG. 2. A one-way valve such as a flapper valve 90 is mounted over the air outlet 82 within the recess 84 so that it opens radially outwardly relative to the central hub 36 of pressure chamber 32.

As shown in FIGS. 2 and 3, each of the outlet tubes 86 is connected to the outlet chamber 88 formed in central hub 36. An air discharge member 92 has a head section 94 fixedly mounted to the support frame 12, and a stem section 95 extending into the central hub 36 which is formed with a passageway 96. This passageway 96 terminates at a port 97 which is connected to a passageway 98 formed in the frame 12. The passageway 98 leads to the discharge passageway 18 formed in extension 16. See FIG. 2.

The stem section 95 of air discharge member 92 is mounted within the central hub 36 to a mount 99 formed with a passageway 100 colinear with the passageway 96. The air discharge member 92 and mount 100 are rotatable relative to the central hub 36 upon the bearing 60. Preferably, a rotary seal 101 is located within the central hub 36 between the chamber 88 and mount 99 to permit rotation of the mount 99 and air discharge member 92 within the central hub 36 while maintaining the chamber 88 substantially air-tight and capable of being pressurized as described below.

The operation of pump 10 is as follows. The high speed shaft 14 is driven by motor 30 through drive belt 26 at relatively high speed which rotates the support frame 12 about its longitudinal axis 15. Because the stub shaft 46 is mounted in a journal 47 to frame 12, the stub shaft 46 rotates with the frame 12 causing gear 48 to orbit around stationary sun gear 50. This rotates the stub shaft 46, which, in turn, rotates the bevel gear 44. The bevel gear 44 rotates the pressure chamber 32, through its driving connection to flange 40, with respect to the transverse axis 52 of the central hub 36 and rod 66. Since the bevel gear 44 is of much smaller diameter than the flange 40, a speed reduction is obtained wherein the hub 36 and pressure chambers 32 rotate at a much slower speed than the high speed shaft 14.

The rotation of pressure chamber 32 with respect to the high speed shaft 14 results in the application of centrifugal force to the water or other liquid or semi-liquid contained within the hollow interior 38 of pressure chamber 32. As shown in FIG. 3, the centrifugal force creates areas or zones of differing fluid pressure within the interior 38 of pressure chamber 32. That is, two zones 102 and 104 of highest fluid pressure are produced at the furthest location within the interior 38 of pressure chamber 32 from the longitudinal axis 15 of high speed shaft 14, and two zones of lowest pressure 106, 108 are produced within the interior 38 of pressure chamber 32 at or near the longitudinal axis 15 of high speed shaft 14. The pumping action of pumping units 68A-D is obtained by rotating the pressure chamber 32 relative to the axis 52 so that the pumping units 68A-D move between the lowest pressure zones 106, 108 and the highest pressure zones 102, 104.

Referring to FIG. 3, pumping units 68A and 68C are located along the longitudinal axis 15 of high speed shaft 14 within the lowest pressure zones 106, 108, respectively. In moving from the highest pressure zones 102, 104 to these lowest pressure zones 106, 108, the fluid pressure applied to each pumping unit 68A, 68C progressively decreases allowing their flexible membranes 74 to expand and move radially outwardly from the cup-shaped face 72 of base 70. This movement of the flexible membrane 74 away from cup-shaped face 72 creates a negative pressure within the chamber 76 therebetween which draws ambient air through the air inlet 78 into the pumping chamber 76. The suction created by outward movement of flexible membranes 74 unseats the flapper valve 80 over the air inlet 78 to permit the entry of air through inlet 78 into chamber 76.

As the pressure chamber 32 rotates relative to the axis 52 on rod 66, the pumping units 68A and 68C are moved from the lowest pressure zones 106, 108 into the highest pressure zones 102, 104, respectively. In moving to these high pressure zones 102, 104 (e.g., where units 68B and 68D are shown in the FIGS.), the flexible membrane 74 of each pumping unit 68A and 68C is progressively forced against the cup-shaped face 72 of base 70. Such movement of flexible membrane 74 forces the air within chamber 76 to open the flapper valve 90 and then flow through the air outlet 82 into the outlet cavity 84 within base 70. The pressurized air travels through outlet tube 86 into the outlet chamber 88 within central hub 36. From the outlet chamber 88 the air moves through the flow path defined by the passageways 100, 96 and 98 to the discharge passageway 18 in extension 16. The pumping units 68A and 68C are then returned to the low pressure zones 106, 108 wherein the flexible membrane 74 is progressively allowed to return to a completely expanded position relative to cup-shaped face 72 for intaking air into the pumping chamber 76 as described above.

It should be understood that the pumping units 68B and 68D undergo the same intake and exhaust cycle described above for units 68A, C, except at alternate time intervals. As shown in FIG. 3, when the pumping units 68A, C are located within lower pressure zones 106, 108 during the air intake cycle, the pumping units 68B, D are being exhausted of air in moving to the higher pressure zones 102, 104. In this manner, the pumping action is essentially continuous and it is contemplated that essentially any number of pumping units could be employed to increase pump capacity.

Figure 4:
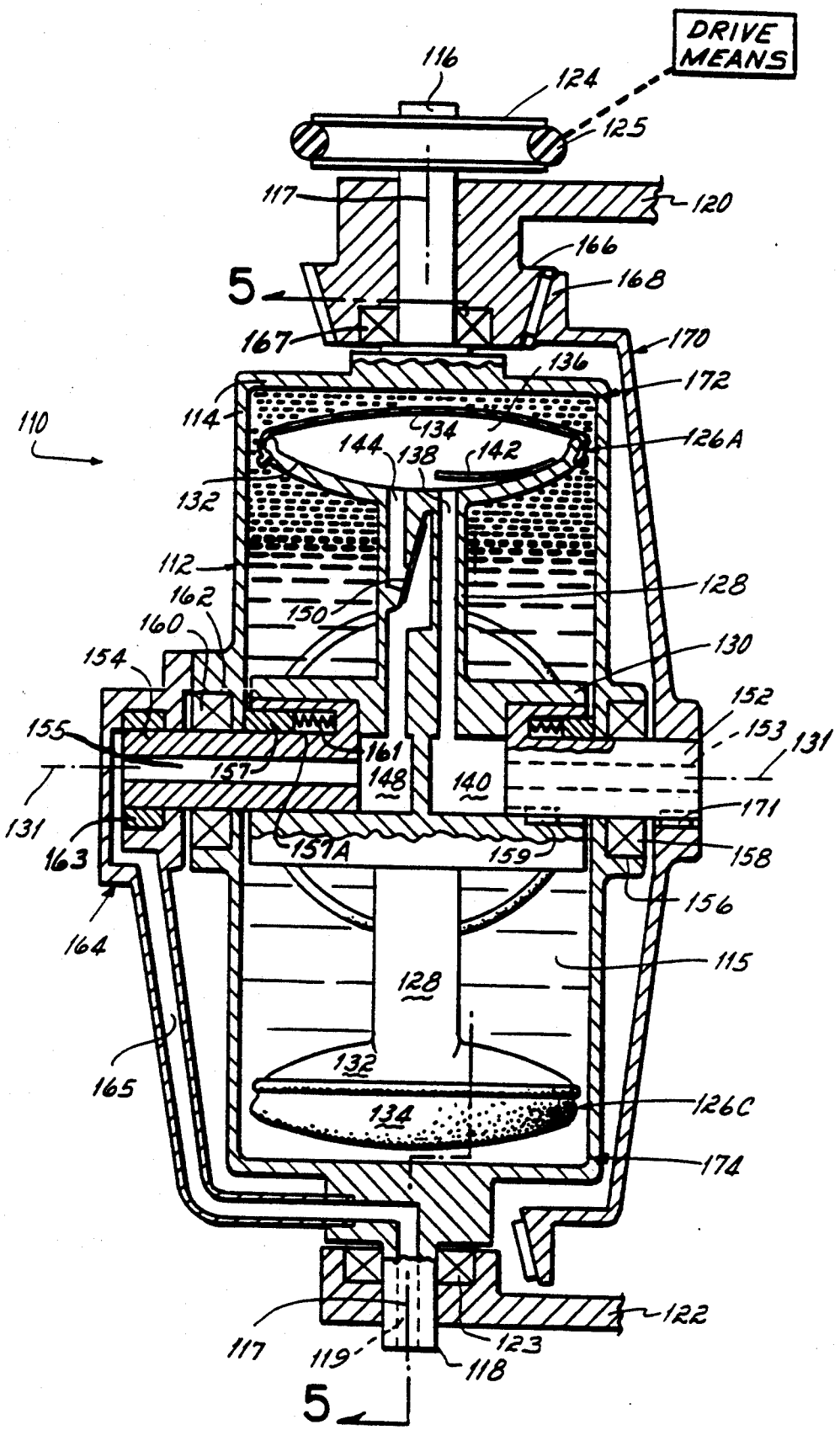
FIG. 4 is an elevational view in partial cross section of an alternative embodiment of this invention.
Figure 5:
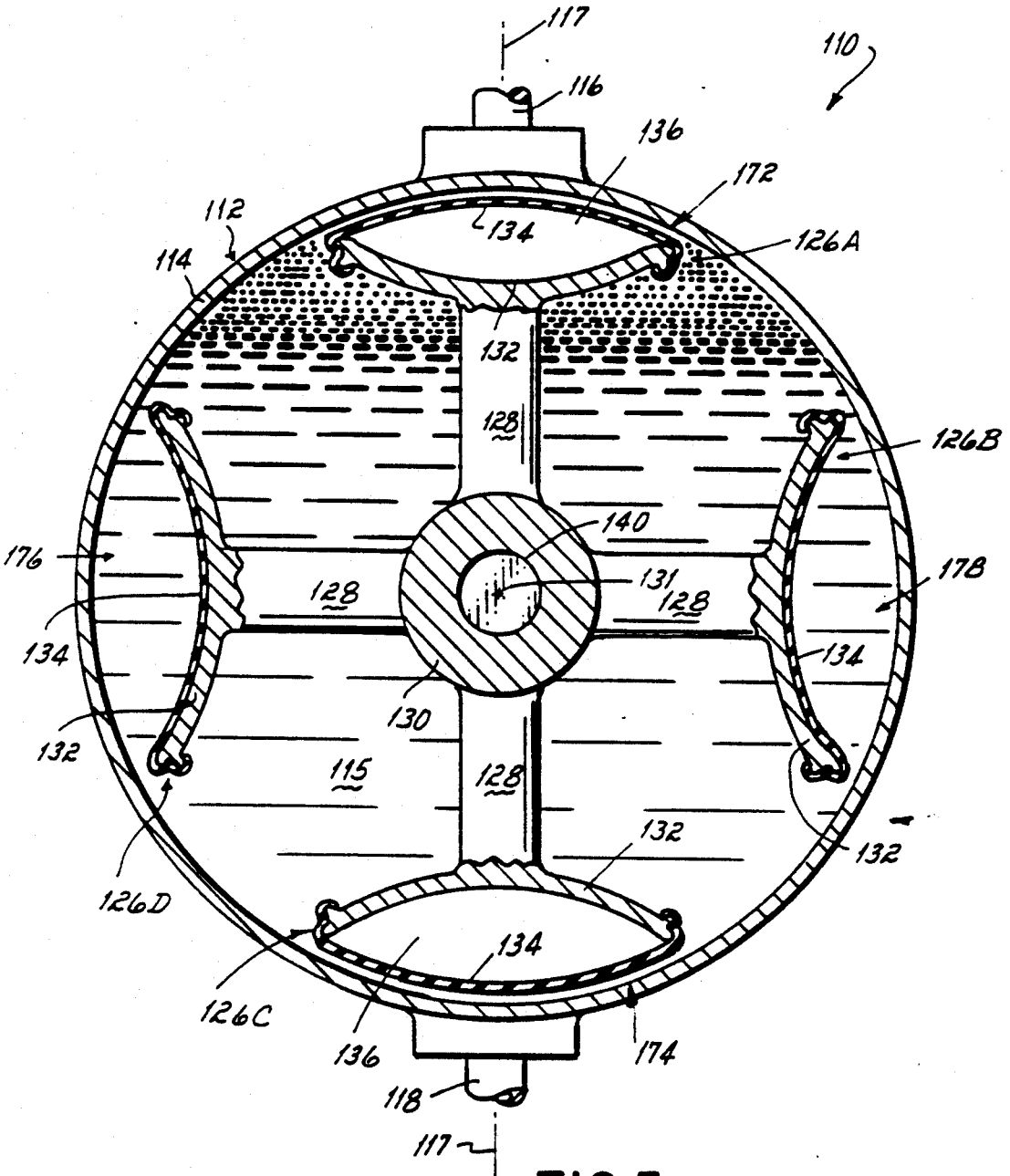
FIG. 5 is a cross sectional view taken generally along line 5—5 of FIG. 4 showing the interior of the pressure chamber and the pumping units of this embodiment.

Referring now to FIGS. 4 and 5, an alternative embodiment of a pump 110 is illustrated which is a modified version of pump 10. The pump 110 employs the same principle of operation as pump 10 wherein pumping units are moved between areas of different fluid pressure in order to first intake and then exhaust air.

Pump 110 comprises a pressure chamber 112 having a cylindrical wall 114 defining a hollow interior 115. The pressure chamber 112 is fixedly connected at one end to a high speed shaft 116, and is formed at the other end with an extension 118 having a passageway 119. The pressure chamber 112 is supported on a surface such as a table (not shown) by a drive bracket 120 and a mounting bracket 122 each mounted by a bearing 123 to the high speed shaft 116 and extension 118, respectively. The high speed shaft 116 mounts a pulley 124 having a belt 125 which is drivingly connected to the output shaft of a motor (not shown). Rotation of the high speed shaft 116 rotates the pressure chamber 112 about the longitudinal axis 117 of high speed shaft 116. Alternatively, the pulley 124 and belt 125 could be eliminated and the output of a motor, e.g., a variable speed motor, could be directly connected to the pressure chamber 112.

The hollow interior 115 of pressure chamber 112 is filled with a liquid such as water and contains four pumping units 126A–D which are mounted at 90° intervals therein. Each pumping unit 126A–D is identical and the same reference numbers are used to identify the same structure in each.

Pumping unit 126A, for example, comprises a hollow, cylindrical-shaped arm 128 extending radially outwardly from a central hub 130. The outer end of arm 128 is formed with a cup-shaped surface 132 which mounts a flexible membrane 134 around its peripheral edge defining a chamber 136 therebetween. The arm 128 is formed with an inlet passageway 138 which extends radially outwardly along arm 128 from an inlet chamber 140 formed in the hub 130. The outer end of inlet passageway 138 terminates at the surface 132 and is covered thereat by a one-way valve such as a flapper valve 142 mounted to the surface 132. An outlet passageway 144 is formed on the opposite side of arm 128 which extends radially inwardly from the surface 132 to an outlet chamber 148 formed in the hub 130. A one-way valve such as a flapper valve 150 is mounted to the arm 128 at a point along outlet passageway 144 which is movable between a closed position covering the outlet passageway 144 and an open position in which the radially inward flapper valve 150 moves to the right as viewed in FIG. 4.

The pumping units 126A–D are mounted within the interior 115 of pressure chamber 112 by a hollow air inlet tube 152 extending through one side of the pressure chamber 112, and a hollow air outlet tube 154 extending through the opposite side of pressure chamber 112. The air inlet tube 152 is formed with a passageway 153 extending from atmosphere to the inlet chamber 140, and the air outlet tube 154 is formed with a passageway 155 having an outer end and an inner end connected to the outlet chamber 148. The tubes 152, 154 each include a fluid packing or seal 157 carried within a cavity **157*a* formed therein which is biased against the inner wall of pressure chamber 112 by a spring 161** to form a seal therebetween.

The pressure chamber 112 is formed with a seat 156 which mounts a bearing 158 within which air inlet tube 152 is rotatable relative to the pressure chamber 112. The inner end of air inlet tube 152 is mounted to the interior of hub 130 by a key 159. The air outlet tube 154 is carried in a bearing 160 mounted in a seat 162 formed at the opposite side of pressure chamber 112. The outer end of air outlet tube 154 is slidably received within a fluid seal 163 carried by a bracket 164 which mounts to the wall 114 of pressure chamber 112. The bracket 164 is formed with a passageway 165 which is connected at one end to the passageway 155 in air outlet tube 154 and at the other end to the passageway 119 of extension 118.

As shown in FIG. 4, a bevel gear 166 is rotatably carried on high speed shaft 116 by a bearing 167 and is fixedly connected to the drive bracket 120. The bevel gear 166 mates with teeth on a beveled edge 168 of an annular drive flange 170 which is fixedly connected to the outer end of air inlet tube 152 by a key 171. The bevel gear 166 is fixed to or integrally formed with the drive bracket 120. The bevel gear 166 acts as a sun gear about which the drive flange 170 rotates, which, in turn, rotates the pumping units 126A–D relative to the longitudinal axis 131 of hub 130 through the connection between air inlet tube 152 and hub 130. The diameter of the drive flange 170 is much greater than that of beveled gear 166 so that the pumping units 126A–D are rotated at a much slower rate about the axis 131 of hub 130 compared to the rate of rotation of the pressure chamber 112 about the longitudinal axis 117 of high speed shaft 116.

The operation of the pump 110 illustrated in FIGS. 4 and 5 is as follows. The relatively high speed rotation of high speed shaft 116 imposes a centrifugal force on the liquid contained within the interior 115 of pressure chamber 112. As shown in FIG. 5, this creates zones of different fluid pressure within pressure chamber 112 depending upon the radial distance from the longitudinal axis 117 of high speed shaft 116. For example, the areas or zones 172, 174 located 180° apart at the top and bottom of pressure chamber 112 as viewed in FIG. 5 are at the lowest fluid pressure within pressure chamber 112 because they are at or near the longitudinal axis 117 of high speed shaft 116. The highest pressure zones 176, 178 with pressure chamber 112 are located 90° from the lower pressure zones 172, 174, i.e., at the furthest locations within pressure chamber 112 from the longitudinal axis 117 of high speed shaft 116 The pumping action of pumping units 126A–D is produced by moving them between the lowest pressure zones 172, 174 and the highest pressure zones 176, 178.

As viewed in FIG. 5, with the pumping units 126A and 126C having been moved to the lowest pressure zones 172, 174, respectively, the flexible membranes 134 thereof are permitted to expand radially outwardly from the surface 132 which draws air through the passageway 153 of air inlet tube 152, into the inlet chamber 140 of hub 130, through the inlet passageway 138 of arm 128 and then past flapper valve 142 into the pumping chamber 136 between the surface 132 and flexible membrane 134.

This air intake cycle is then followed by an exhaust cycle. When the pumping units 126A, C are moved from the lowest pressure zones 172, 174 to the highest pressure zones 176, 178, the flexible membranes 134 are progressively forced against the surface 132. This exhausts the air from within pressure chamber 136 into the outlet passageway 144 of arm 128, past the flapper valve 150, and then into the outlet chamber 148 of hub 130. The air exits the hub 130 through the passageway 155 in air outlet tube 154 and then flows through the passageway 165 in bracket 164 to the discharge passageway 119 in extension 118. Continuous movement of the four pumping units 126A–D through the fluid pressure zones within pressure chamber 112 is effective to continuously pump a fluid such as air, or to evacuate fluid from a container, depending upon the particular application for pump 110.

Figure 7:
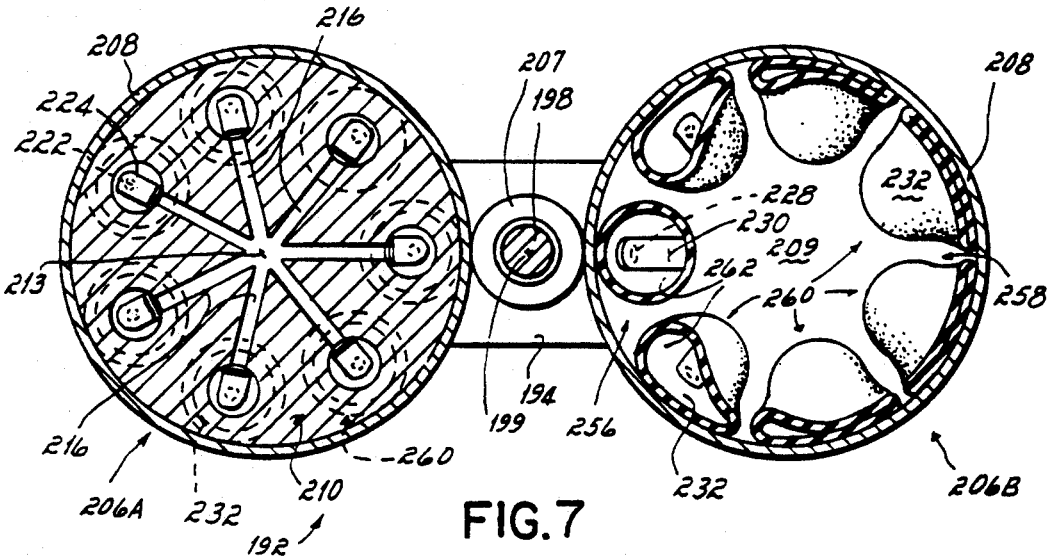
FIG. 7 is a cross sectional view taken generally along line 7—7 of FIG. 6 showing the interior of the pressure chamber and the pumping units of this embodiment.
Figure 6:
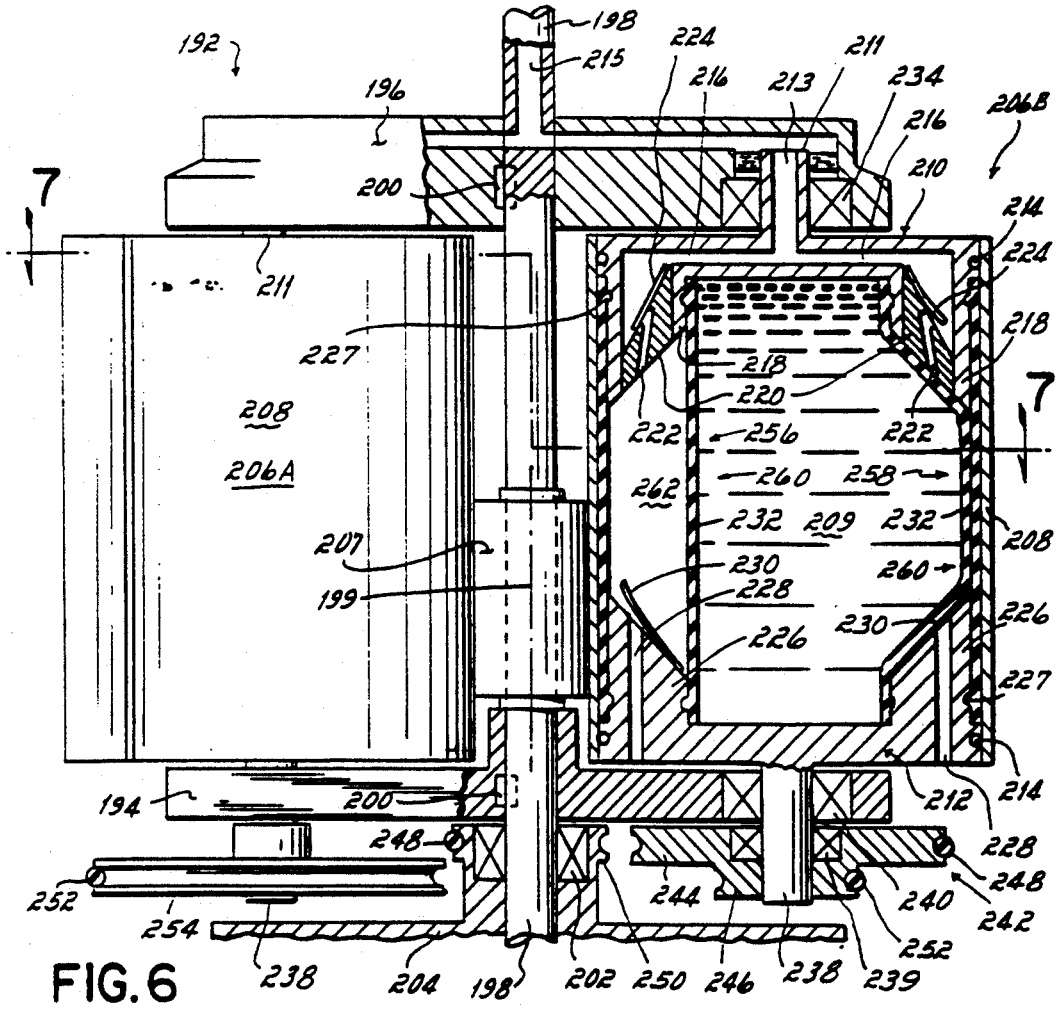
FIG. 6 is an elevational view in partial cross section of a third embodiment of this invention.

Referring now to FIGS. 6 and 7, a still further embodiment of the centrifugal force-type, positive displacement pump of this invention is illustrated. The pump 192 of FIGS. 6 and 7 operates in a manner similar to pumps 10 and 110 described above with one primary distinction. In pumps 10 and 110, the pressure chamber rotates about a first axis and the pumping units rotate about a second axis oriented perpendicular to the first axis. The construction of pump 192 is such that the axis of rotation of the pressure chamber is parallel to the axis of rotation of the pumping units, as described below. Otherwise, the pump 192 is essentially identical in operation to those described in the embodiments of FIGS. 1–5.

The pump 192 comprises a lower platform 194 and an upper platform 196 which carry a high speed shaft 198 connected thereto by keys 200. The high speed shaft 198 is mounted by a bearing 202 to a fixed base 204 and is driven by the output of a motor (not shown).

The lower and upper platforms 194, 196 mount two pressure chambers 206A and 206B for rotation about the longitudinal axis 199 of high speed shaft 198. A friction drive roller 207 is carried on the high speed shaft 198 between the chambers 206A, B. As shown in FIG. 6, pressure chamber 206B, for example, comprises a cylindrical-shaped outer wall 208 having a top end which mounts an outlet plate 210 and a bottom end which mounts an inlet plate 212 each sealed thereto by an O-ring 214. The plates 210, 212 and outer wall 208 define a hollow interior 209 which is preferably filled with a liquid such as water or a semi-liquid. The outlet plate 210 is formed with discharge passageway 213 connected to a central outlet 215, and a plurality of branch lines 216 which extend radially outwardly therefrom. See FIG. 7. Each of the branch lines 216 terminate at a sleeve 218 which mounts an insert 220 having an outlet passageway 222 whose outer end is covered by a one-way flapper valve 224. The inlet plate 212 is formed with a plurality of upright extensions 226 each having an inlet passageway 228 whose inner end is covered by a one-way valve such as a flapper valve 230.

Each of the sleeves 218 vertically aligns with an upright extension 226, and a flexible cylindrical-shaped tube 232 extends therebetween. A seat 227 is formed in the outer surface of both the sleeve 218 and the extension 226 to mount an end of the cylindrical tube 232, and a portion of the wall of the cylindrical tube 232 is captured between the outer wall 208 of pressure chamber 206B and both the sleeve 218 and extension 226. In the illustrated embodiment of FIGS. 6 and 7, there are a total of seven pairs of sleeves 218 and extensions 226 each of which support a separate flexible cylindrical tube 232. It should be understood that any number of sleeves 218 and extensions 226 could be employed.

Each of the pressure chambers 206A, B is mounted for rotation with respect to the lower and upper platforms 194, 196. The hub 211 of outlet plate 210 is rotatably carried in a bearing 234 mounted in the upper platform 196. A low speed shaft 238 is mounted to the base of inlet plate 212 and this shaft 238 is carried within a bearing 240 mounted in the lower platform 194. A portion of the low speed shaft 238 extends beneath the lower platform 194 and mounts a bearing 239 which carries a stepped spool 242 having a larger diameter upper spool 244 and a smaller diameter lower spool 246. The upper spool 244 is connected by a belt 248 to a spool 250 formed at the top of the base 204 which mounts the lower end of high speed shaft 198. The lower spool 246 is connected by a belt 252 to a follower spool 254 carried at the base of the low speed shaft 238 of pressure chamber 206A.

In response to rotation of the high speed shaft 198, the upper and lower platforms 196, 194 rotate relative to the longitudinal axis of such shaft 198. Stepped spool 242 orbits about the fixed spool 250 with the rotation of lower platform 196, and belt 248 causes the stepped spool 242 to rotate about the low speed shaft 238. In turn, the follower spool 254 is rotated by the lower spool 246 of stepped spool 242 via belt 252 connected therebetween. The rotation of follower spool 254 drives pressure chamber 206A, which, through friction drive roller 207, rotates pressure chamber 206B. The pressure chambers 206A and 206B are both driven at the same rotational speed by the spools 242, 254, and this speed is substantially less than that of the high speed shaft 198.

The operation of the pump 192 of FIGS. 6 and 7 is as follows. In response to rotation of the high speed shaft 198, the pressure chambers 206A, B are rotated by platforms 194, 196 at relatively high speed. Such rotation imposes a centrifugal force on the liquid which is contained in the hollow interior 209 of each pressure chamber 206A, B. This centrifugal force creates zones of differential fluid pressure within the chambers 206A, B wherein a lowest pressure zone 256 is formed nearer the longitudinal axis 199 of high speed shaft 198, and a highest pressure zone 258 is formed at the furthest radial distance from the axis 199 of high speed shaft 198 within each pressure chamber 206A, B.

Each vertically aligning sleeve 218 and extension 226, and the cylindrical tube 232 extending therebetween, forms a separate pumping unit 260 having a pumping chamber 262 within the interior of the cylindrical tube 232. When the pumping units 260 are rotated from the highest pressure zone 258 into the lowest pressure zone 256, the flexible cylindrical tubes 232 are permitted to progressively expand and thereby create a negative pressure within the pumping chamber 262. Air or other fluid is drawn through the inlet passageway 228 in the extensions 226, past flapper valve 230 and into the pumping chamber 262 within each cylindrical tube 232.

After having been filled with fluid, the pumping units 260 are then rotated within the pressure chambers 206A, B about the axis of the low speed shaft 238 from the lowest pressure zone 256 to the higher pressure zone 258. In the course of moving to the highest pressure zone 258, the flexible cylindrical tubes 232 are squeezed together forcing the air within pumping chamber 262 through the outlet passageway 222 in the insert 220 of sleeve 218, past the flapper valve 224 therein and into a branch line 216. See righthand side of FIG. 6. The air exits the branch line 216 through the passageway 213 of hub 211 and into the discharge passageway 213 of the upper platform 196. The pumping units 260 are then rotated back to the low pressure zone 256 where the process is repeated.

Referring now to FIGS. 8–12, alternative embodiments of the pump of this invention are illustrated. As will become apparent below, the pumps of these embodiments differ from those described above in that a ring is rotated at high speed relative to an axis instead of liquid or semi-liquid filled pressure chambers. Pumping units are movable with respect to the inner or outer surface of the wall of the ring to intake and exhaust fluid. Importantly, the center of gravity of the ring is maintained at a fixed location with respect to the high speed axis of rotation as in the embodiments of FIGS. 1-7 employing a liquid or semi-liquid filled chamber.

Figure 8:
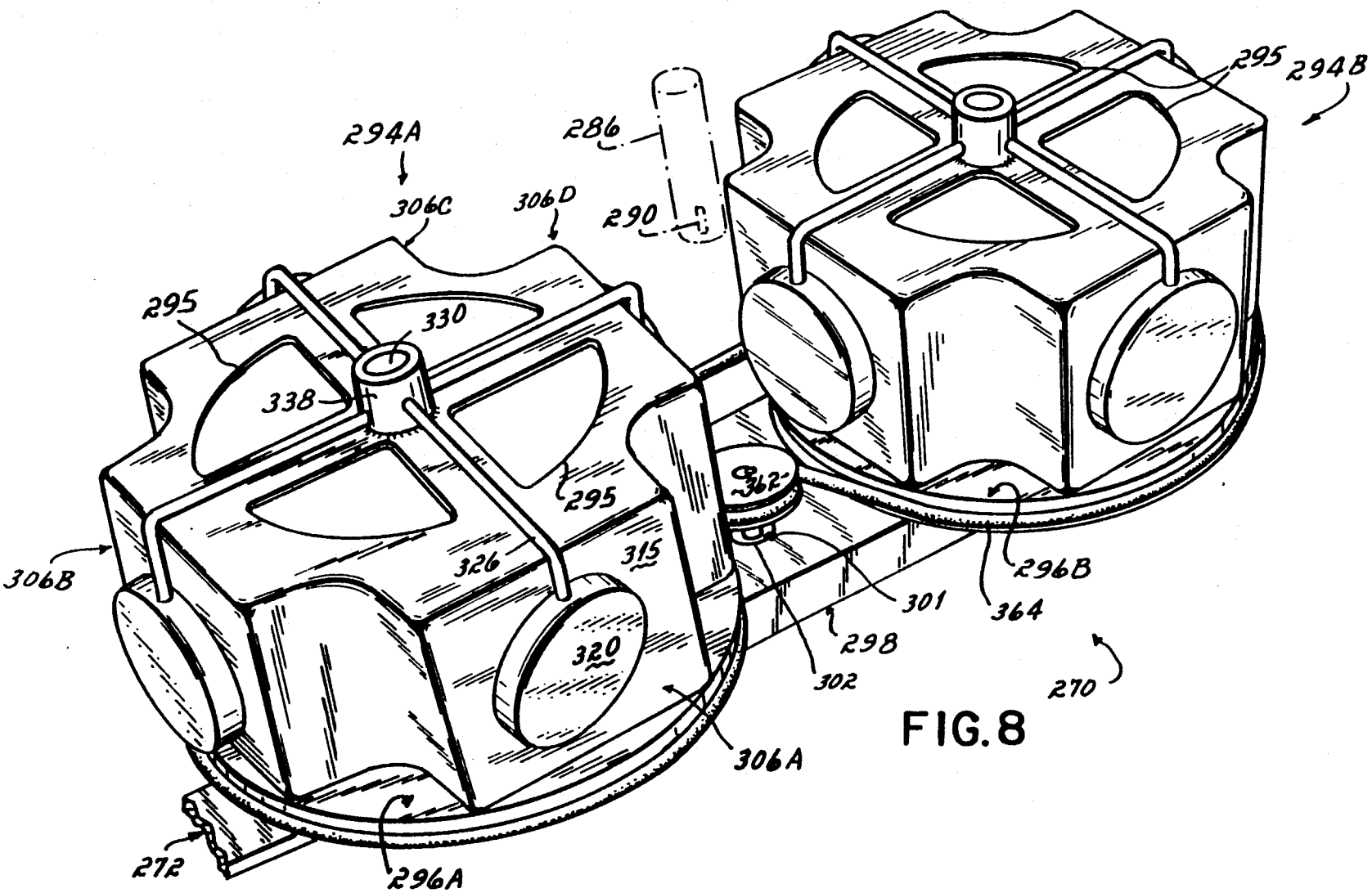
FIG. 8 is a schematic, perspective view of still another alternative embodiment of this invention.
Figure 9:
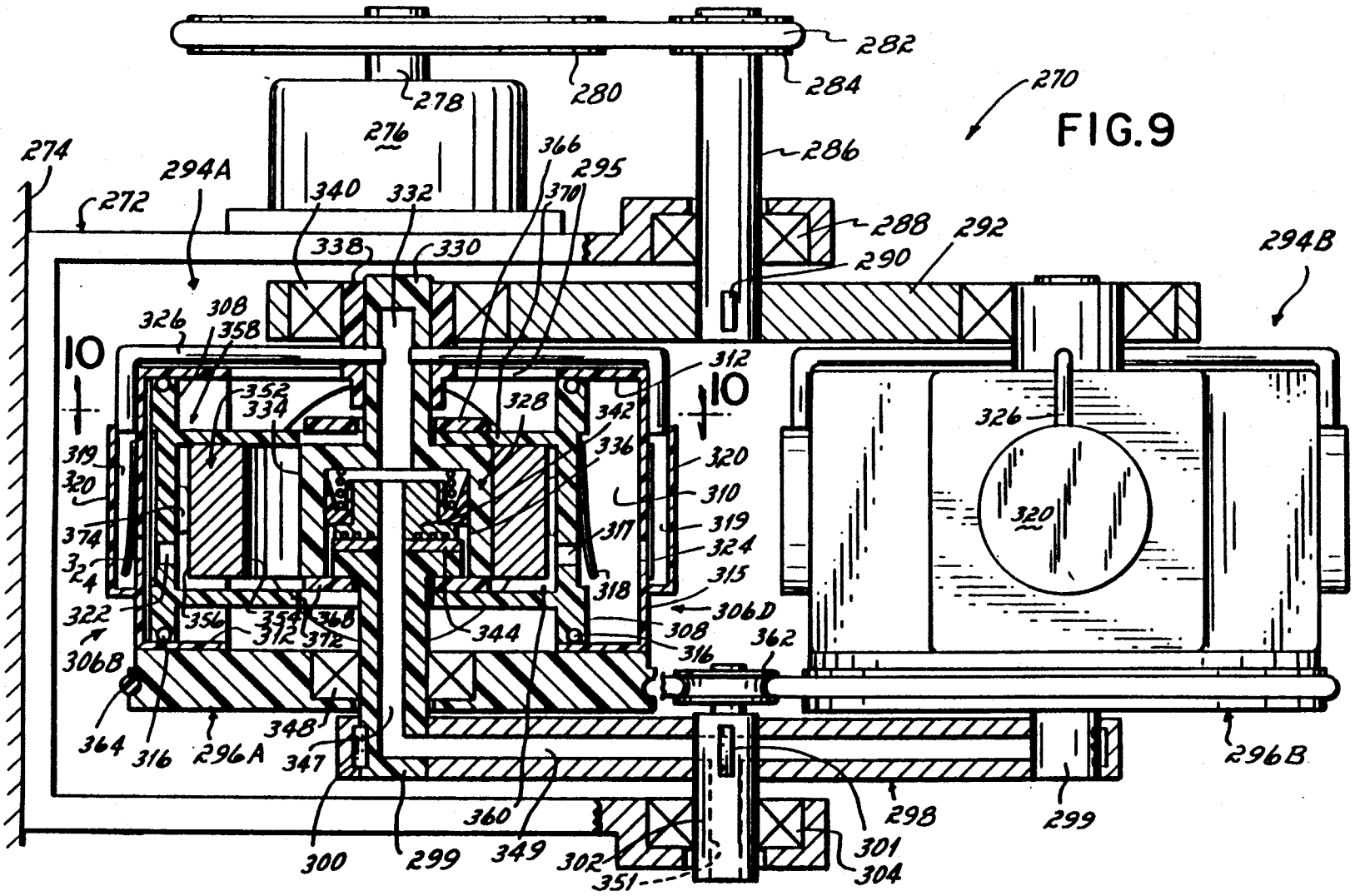
FIG. 9 is an elevational view in partial cross section of the embodiment of FIG. 8.
Figure 10:
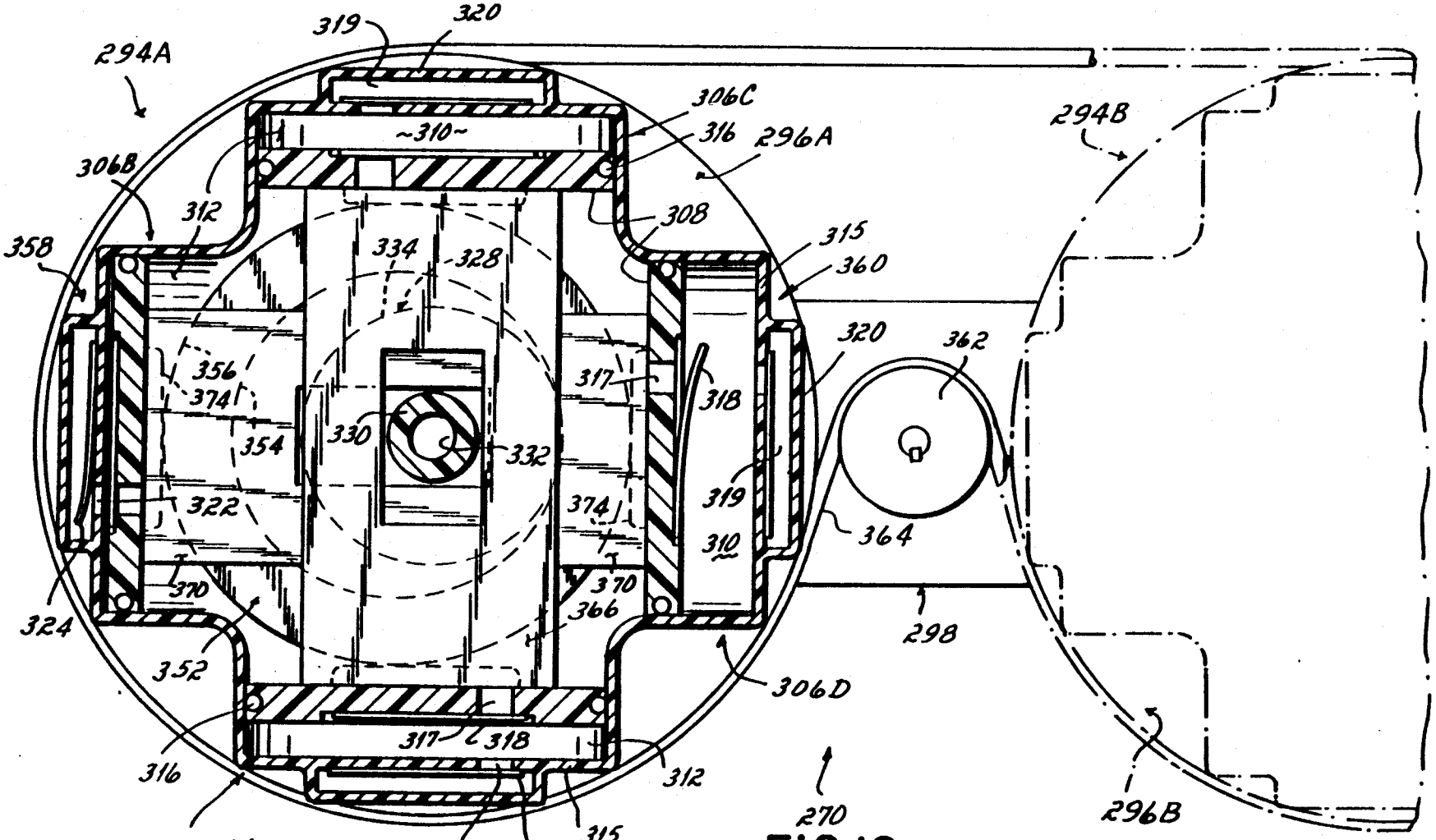
FIG. 10 is a cross sectional view taken generally along line 10—10 of FIG. 9.

Referring to FIGS. 8-10, the pump 270 is illustrated which comprises a mounting bracket 272 supported on a surface as at 274. The mounting bracket 272 supports a motor 276 having an output shaft 278 which carries a pulley 280. The pulley 280 is drivingly connected by a belt 282 to a pulley 284 fixed to a high speed shaft 286. The high speed shaft 286 is carried in a bearing 288 in the mounting bracket 272 and is fixed by a key 290 to a plate 292.

The plate 292 extends between a first pump housing 294A and a second pump housing 294B which are carried on base plates 296A, B, respectively. Each of the pump housings 294A, B are formed with openings 295 at the top to permit the flow of air therethrough as described more fully below. The base plates 296A, B are each mounted on a base support 298 by a support shaft 299 which is connected by a key 300 thereto. The base support 298 is fixed by a key 301 to a stub shaft 302 mounted in a bearing 304 to the mounting bracket 272. The construction and operation of pump housings 294A, B is identical and the following description is concerned with pump housing 294A which is equally applicable to pump housing 294B.

The pump housing 294A encloses four pumping units 306A-D. As shown in detail in FIGS. 9 and 10, each pumping unit 306A-D comprises a piston 308 movable within an annular pumping chamber 310 defined by an annular side wall 312 and an outer wall 315. The piston 308 has an O-ring 316 which is movable along the side wall 312 defining the pumping chamber 310 to create a fluid-tight seal therebetween. A port 317 is formed in the piston 308 which is covered by a one-way valve such as a flapper valve 318 carried on the outer side of the piston 308.

The piston 308 is movable within pump housing 294A toward and away from an air outlet chamber 319 formed by a cap 320 fixed to the outer wall 315 of the pump housing 294A. The outer wall 315 is formed with a port 322 which extends between the interior of the pumping chamber 310 and the air outlet chamber 319. A one-way valve or flapper valve 324 is mounted on the outer wall 315 within the cap 320 over the port 322. An exhaust line 326 is connected to the upper portion of cap 320 for transmitting air or another fluid therethrough as described in detail below.

A hub 328 is located at the center of pump housing 294A which is formed with an upper portion 330 having a passageway 332, and a lower portion 334 formed with a larger diameter bore 336. The upper portion 330 of hub 328 is fixedly mounted to a sleeve 338 which forms the top of pump housing 294A. This sleeve 338 is carried within a bearing 340 mounted to the plate 292. The lower portion 334 of hub 328 is carried by a thrust bearing 342 having a wear plate 344 which rests atop the support shaft 299. The thrust bearing 342 and wear plate 344 also function as a rotary seal. As mentioned above, the support shaft 299 extends downwardly from the wear plate 344 through the base plate 296A which supports pump housing 294A and then to the base support 298. A bearing 348 permits rotation of the base plate 296A relative to the support shaft 299, and the key 300 fixedly mounts the support shaft 299 to the base support 298.

As shown in FIG. 9, a ring 352 is located within the interior of pump housing 294A having an inner wall 354 which faces the lower portion 334 of hub 328, and an outer wall 356 which faces the pistons 308 of pumping units 306A-D. In the presently preferred embodiment, the ring 352 is donut-shaped, i.e., with annular inner and outer walls 354, 356, although it is contemplated that the ring 352 could also be formed in an oval shape or the like. Preferably, the ring 352 is formed of a relatively dense, heavy material such as metal, e.g., lead, steel, etc., or any other suitable relatively material.

In the presently preferred embodiment, the pumping units 306A-D are oriented at 90° intervals about the hub 328 and around the outside of ring 352. Preferably, the pumping units opposite to one another are interconnected by brackets. That is, the pistons 308 of pumping units 306A and 306C are interconnected by an upper bracket 366 and lower bracket 368. Similarly, the pistons 308 of pumping units 306B and 306D are interconnected by upper and lower brackets 370, 372, respectively. As discussed below, the pistons 308, pumping units 306A, C and 306B, D therefor each move in pairs as a unit within the pumping chamber 310 of the respective pumping units to intake and exhaust air.

The pump 270 operates as follows. In response to rotation of the high speed shaft 286, the pump housings 294A, B are rotated about the longitudinal axis of shaft 286 through their connection to plate 292 via hub 328. In turn, the stub shaft 302 is rotated on bearing 304 at the same speed. Rotation of the pump housings 294A, B about high speed shaft 286 creates a centrifugal force which throws the ring 352 radially outwardly against the lower portion 334 of hub 328 as viewed in FIG. 9. This creates an area or zone 358 along the ring 352 at the furthest radial distance from the longitudinal axis of high speed shaft 286 at which a higher force can be exerted against the pumping units 306A-D, and an area or zone 360 at the opposite side of the ring 352 closest to high speed shaft 286 at which a lower force can be exerted against the pumping units 306A-D. See FIG. 9.

The pumping units 306A-D are movable through these zones 358, 360 by rotation of the pump housings 294A, B relative to the support shaft 299. This rotation is obtained by a pulley 362 mounted at the top of stub shaft 302 which is drivingly connected via belt 364 to the base plates 296A, B which mount the pump housings 294A, B, respectively. The base plates 296A, B orbit about the pulley 362 and this rotation is transmitted directly to the pump housings 294A, B mounted thereon and thus to the pumping units 306A-D.

As the pump housings 294A, B rotate, the pumping units 306A-D are carried therewith and rotate with respect to the outer wall 356 of the ring 352. As seen in FIGS. 9 and 10, when the pumping unit 306B moves into the higher force zone 358, an extension 374 on its piston 308 contacts the outer wall 356 of ring 352 thus forcing the piston 308 of pumping unit 306B toward the cap 320. When the piston 308 of pumping unit 306B moves to the left as viewed in FIGS. 9 and 10, the upper and lower brackets 370, 372 pull the piston 308 of pumping unit 306D in the same direction so that the piston 308 of pumping unit 306D within the lower force zone 360 moves toward the outer wall 356 of ring 352. The pumping units 306A, C are located at 90° intervals from pumping units 306B, D and their pistons 308 contact the outer wall 356 of ring 352 so that they are moved to an intermediate position within their respective pumping chambers 310 as shown in FIG. 9.

The intake and exhaust of air or other fluid from the pump 270 occurs as follows. In the course of moving from the higher force zone 358 toward the lower force zone 360, the piston 308 of each pumping unit 306A-D is moved away from the outer wall 315 of the pumping chamber 310 to a location at the lower force zone 360 wherein the pumping chamber 310 has a highest volume, i.e., where the piston 308 is spaced furthest away from the outer wall 315 of pumping chamber 310. Such movement of the pistons 308 creates a negative pressure within the pumping chamber 310 with draws air into the openings 295 in pump housings 294A, B, through the port 314 in piston 308 and past the flapper valve 318 into the pumping chamber 310. By the time the pumping units 306A-D each reach the lower force zone 360, their piston 308 has been moved to its inwardmost position along the outer wall 356 of ring 352 and spaced from the cap 320. In this position, the maximum volume of air is contained within the pumping chamber 310 of each pumping unit 306A-D.

As shown in FIG. 10, movement of one piston 308 to the extended position furthest from the outer wall 315 of pressure chamber 310 is caused by contact of the piston 308 opposite thereto with the ring 352. For example, piston 308 of pumping unit 306D moves to the position shown in FIG. 10 because the piston 308 of pumping unit 306B contacts ring 352 and the two pistons 308 are interconnected by upper and lower brackets 370, 372.

The exhaust cycle of pump 270 is obtained upon movement of each pumping unit 306A-D from the lower force zone 360 along the outer wall 356 of ring 352 to the higher force zone 358. In the course of movement in this direction, the piston 308 of each pumping unit 306A-D is progressively forced toward the outer wall 315 of pumping chamber 310 by contact with ring 352, thus closing flapper valve 318 on piston 308 and opening the flapper valve 324 covering the port 322 in the outer wall 315 at the entrance to the air outlet chamber 319 formed by cap 320. The pistons 308 are forced to a position nearly in contact with or in actual contact with the outer wall 315 at the highest pressure zone 358 wherein all of the air previously contained within the pumping chamber 310 has been discharged into the air outlet chamber 319. The air entering the air outlet chamber 319 flows through the discharge lines 326 and into the passageway 332 in the upper portion 330 of hub 328. The air continues through the lower portion 334 of hub 328 and enters a passageway 347 formed in the support shaft 299. The air continues on through a passageway 349 in base support 298 and exits the pump 270 through a discharge passageway 351 in the stub shaft 302.

Figure 11:
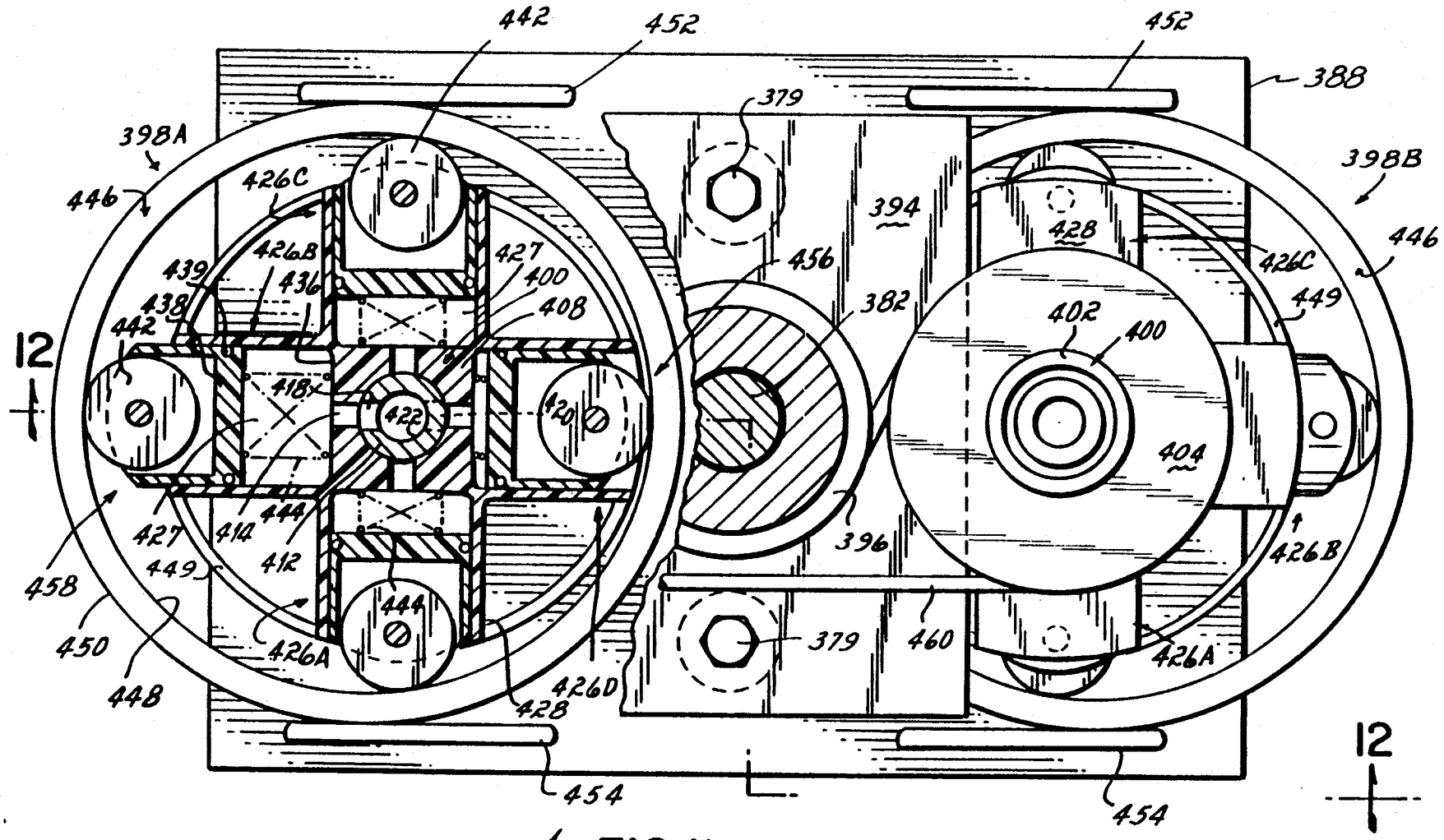
FIG. 11 is a plan view of another alternative embodiment of this invention.
Figure 12:
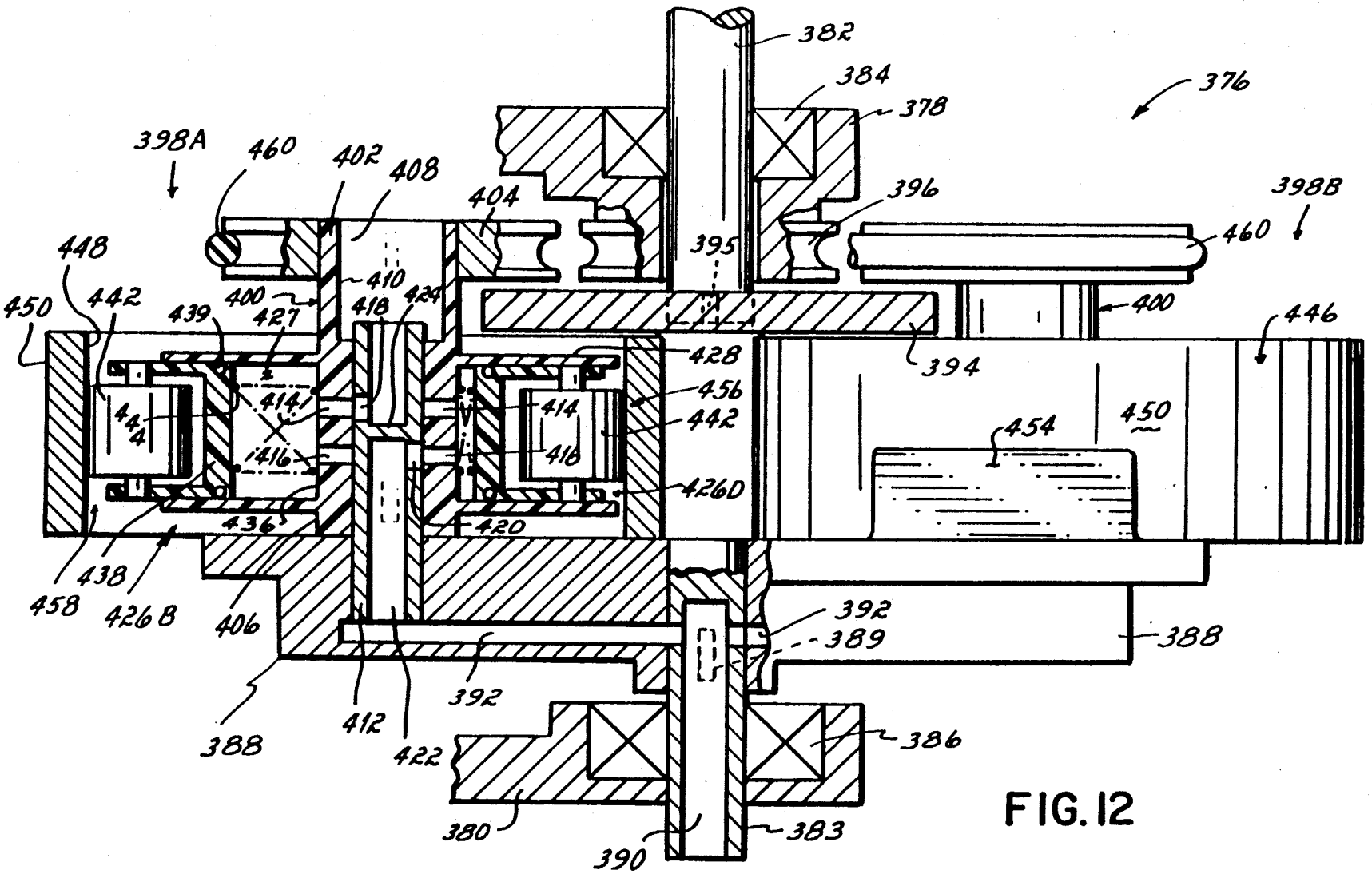
FIG. 12 is a cross sectional view taken on lines 12—12 of FIG. 11.

Referring now to FIGS. 11 and 12, a still further embodiment of this invention is illustrated. The pump 376 of this embodiment is similar to that illustrated in FIGS. 8-10 in that a relatively dense, heavy ring is employed to create zones at which differing forces can be applied to pumping units. As discussed below, in this embodiment, pumping units are movable into engagement with the inner surface or wall of the annular ring instead of the outer wall thereof as in the embodiment of FIGS. 8-10.

The pump 376 comprises an upper mounting bracket 378 and a lower mounting bracket 380. The upper mounting bracket 378 mounts a high speed shaft 382 on a bearing 384. A flange or plate 394 is fixedly mounted by a key 395 at the lower portion of high speed shaft 382 immediately beneath a pulley 396 formed on the upper mounting bracket 378. Bolts and spacers 379 extend between the flange 394 and a base plate 388 so that the base plate 388 is rotatable with the high speed shaft 382. A support shaft 383 is mounted to the base plate 388 via a key 389 and is carried in a bearing 386 in the lower mounting bracket 380 to support the base plate 388. A passageway 390 is formed in the support shaft 383 which communicates with a passageway 392 in the base plate 388.

The base plate 388 supports a pumping assembly 398A and a pumping assembly 398B located on opposite sides of the high speed shaft 382. The pumping assembly 398A is illustrated in detail in the FIGS. 11 and 12, and it should be understood that the pumping assembly 398B is identical in structure and operation.

Pumping assembly 398A comprises a hub 400 having an upper end 402 which mounts a pulley 404 and a lower end 406 which is rotatable upon the top surface of base plate 388. The hub 400 has a central column 408 formed with a stepped axial bore 410 which receives a support shaft 412 fixedly mounted to the base plate 388. The column 408 of hub 400 is formed with four inlet ports 414 which are spaced 90° apart in the same horizontal plane, and four outlet ports 416 which are also spaced 90° apart beneath the inlet ports 414. The support shaft 412 has an upper port 418 which is alignable with each of the inlet ports 414, and a lower port 420 which is alignable with each of the outlet ports 416. The support shaft 412 is formed with an axial bore 422 which is divided by a horizontal plate 424 positioned between the upper port 418 and lower port 420 of the support shaft 412.

The hub 400 is formed with four pumping units 426A-D which extend radially outwardly from the central column 408 at 90° intervals. Each pumping unit 426A-D comprises a tubular-shaped housing defining a pumping chamber 427 having an annular side wall 428 and an inner wall 436 at the outer surface of the central column 408 of hub 400. The outer end of the pumping units 426A-D is open and receives a piston 438 having an O-ring 439 which, along with the wall forms the pumping chamber 427. The outer end of the piston 438 mounts a roller 442, and a spring 444 is mounted between the inner end of the piston 438 and the inner wall 436 of pumping unit 426A-D.

In the presently preferred embodiment, an annular ring 446 having an inner wall 448 and an outer wall 450 is provided which is preferably formed of a relatively dense or heavy material such as metal. The ring 446 is located between the flange 394 and base plate 388 on its top and bottom, and the sides of the ring 446 are confined by guides 452 and 454 carried on the base plate 388. See FIG. 11. The inner wall 448 of ring 446 faces the hub 400 so that the roller 442 of the piston 438 in each pumping unit 426A-D is engageable with the inner wall 448 of ring 446.

The pump 376 of this embodiment operates as follows. The high speed shaft 382 is rotated by a motor or other drive means (not shown) so that the base plate 388 and hub 400 rotate with respect to the longitudinal axis of the high speed shaft 382. This rotation imposes a centrifugal force on the ring 446 which throws it radially outwardly from the high speed shaft 382 along the guides 452, 454 so that its inner wall 448 engages one or more of the pumping units 426A-D as well as a flange 449 which extends between the cylinders 426A-D and support ring 446. The centrifugal force on ring 446 creates a zone 456 closest to the high speed shaft 382 at which a higher force can be exerted on pumping units 426A–D, and a zone 458 furthest from the high speed shaft 382 at which a lower force can be exerted on pumping units 426A–D. The zone 456 is the highest force zone because substantially all of the weight of the ring 446 which is thrust radially outwardly by centrifugal force is applied to the pumping units 426A–D thereat.

The pumping units 426A–D are then made to rotate along the inner wall 448 of ring 446 by a drive train consisting of the pulley 396 formed on the upper mounting bracket 378 and the pulley 404 mounted to the upper end of hub 400. The pulley 404 orbits about the pulley 396 through the connection of belt 460 therebetween. In turn, the hub 400 and its pumping units 426A–D are rotated atop the base plate 388 relative to the ring 446.

As best shown in FIG. 11, each pumping unit 426A–D is movable between an exhaust position at the higher force zone 456 along the ring 446 and an intake position at the lower force zone 458 along the ring 446. With a pumping unit 426 positioned at the higher force zone 456, as for example pumping unit 426D in FIG. 12, the roller 442 of piston 438 engages the inner wall 448 of ring 446 and the piston 438 is forced inwardly into close proximity with the inner wall 436 of pumping unit 426D. As the hub 400 rotates with respect to the ring 446, the distance between the roller 442 and inner wall 448 of ring 446 increases, thus allowing the spring 444 to force the piston 438 radially outwardly from the inner wall 436 of pumping chamber 440.

The movement of the piston 438 within the pumping chamber 427 of each pumping unit 426A–D provides the pumping action of pump 376. The radial outward movement of piston 438, caused by spring 444, draws air into the central column 408 of hub 400 through the upper port 418 of support shaft 412 and then into the port 414 of central column 408. This intake of air within the pumping chamber 427 of a pumping unit 426A–D occurs when the inlet port 414 in the central column of hub 400 aligns with the upper port 418 in support shaft 12 at the lower force zone 458. When the pumping units 426A–D continue moving out of the lower force zone 458, the inlet port 414 in the central column 408 of hub 400 is positioned out of alignment with the upper port 418 in support shaft 412 to maintain the air within pumping chamber 427.

As each of the pumping units 426A–D move from the lower force zone 458 toward the higher force zone 456, the roller 442 of piston 438 contacts the inner wall 448 of ring 446. The piston 438 is progressively moved inwardly toward the inner wall 436 of pumping chamber 440 as it contacts the ring 446. This inward movement of piston 438 compresses the air within the pumping chamber 440. When the pumping units 426A–D reach the higher force zone 456, the outlet port 416 in the central column 408 aligns with the lower port 420 in support shaft 412. The air within the pumping chamber 440 of each pumping unit 406A–D exits through ports 416, 420 and then into the axial bore 422 of support shaft 412. The air continues moving through the passageway 392 and base plate 388 and then out the passageway 390 in the shaft 383. When the pumping units 426A–D have reached the higher force zone 456, their piston 438 is at the fully retracted position and pumping chamber 427 is essentially completely evacuated of air. The process is then repeated.

Figure 13:
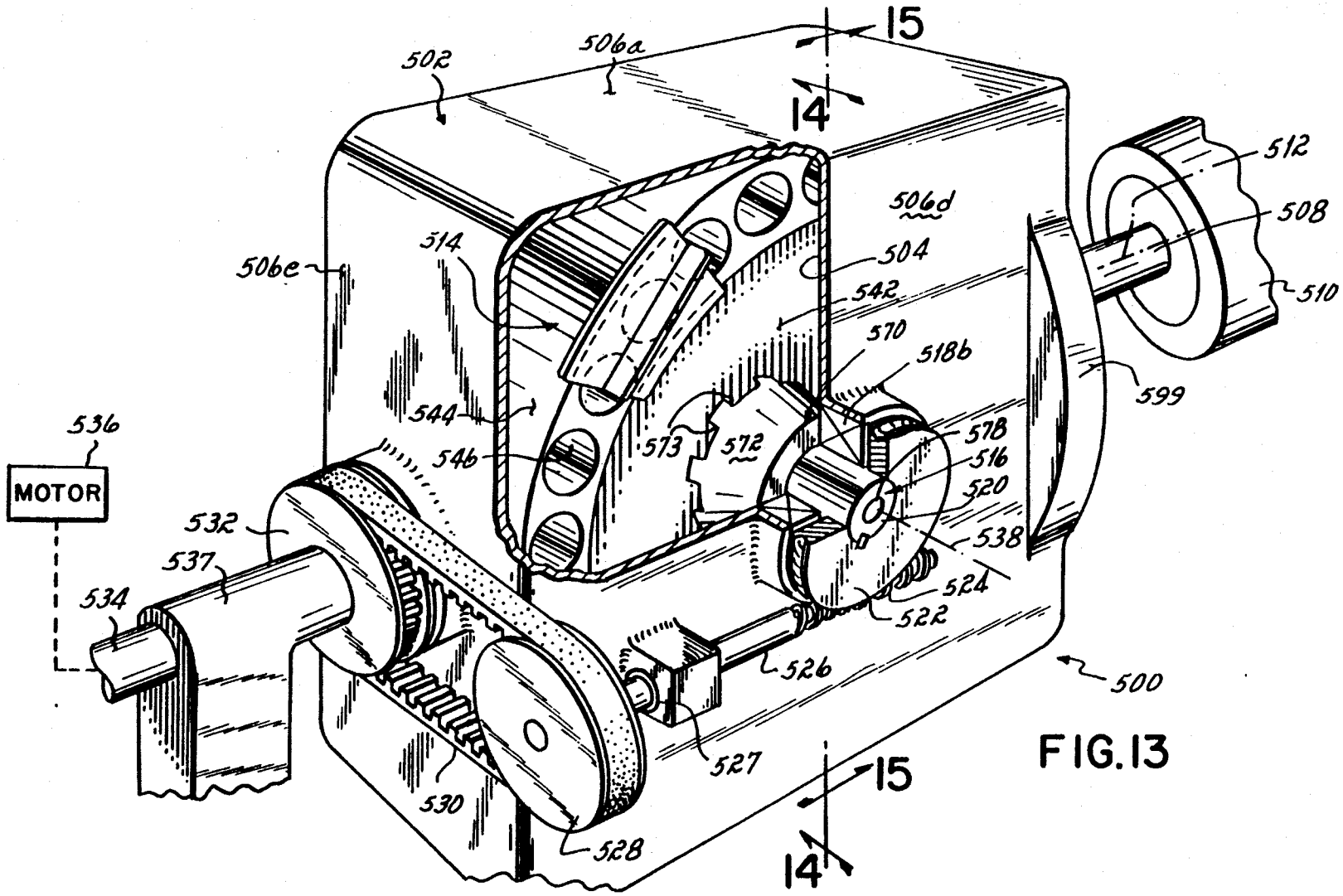
FIG. 13 is a partially cut-away elevational view illustrating a still further alternative embodiment of this invention.
Figure 15:
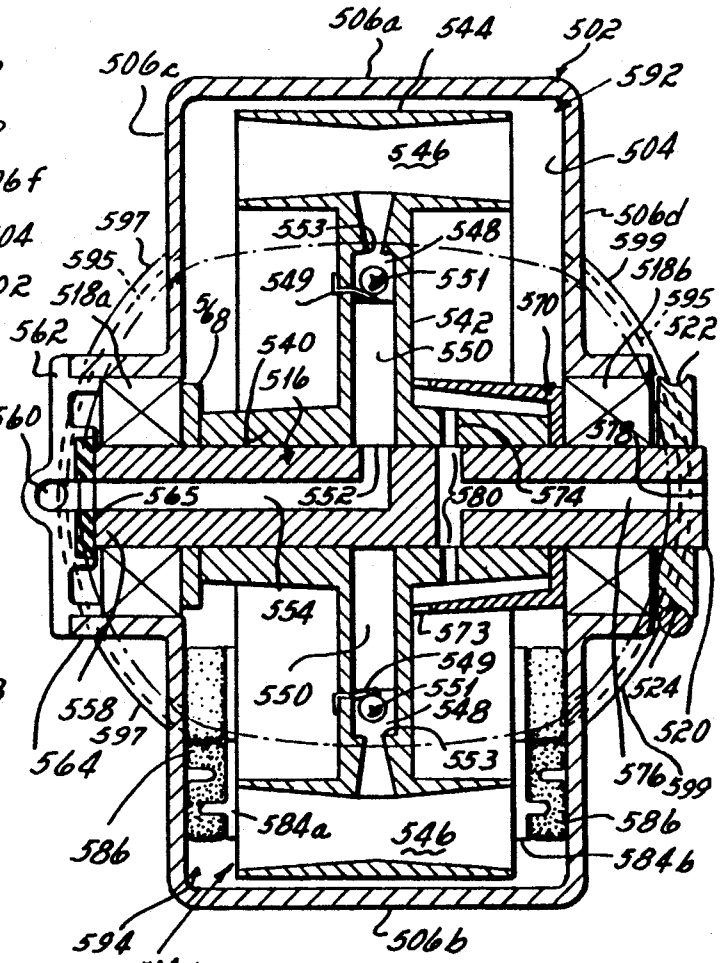
FIG. 15 is a cross sectional view taken generally along line 15—15 of FIG. 13.
Figure 14:
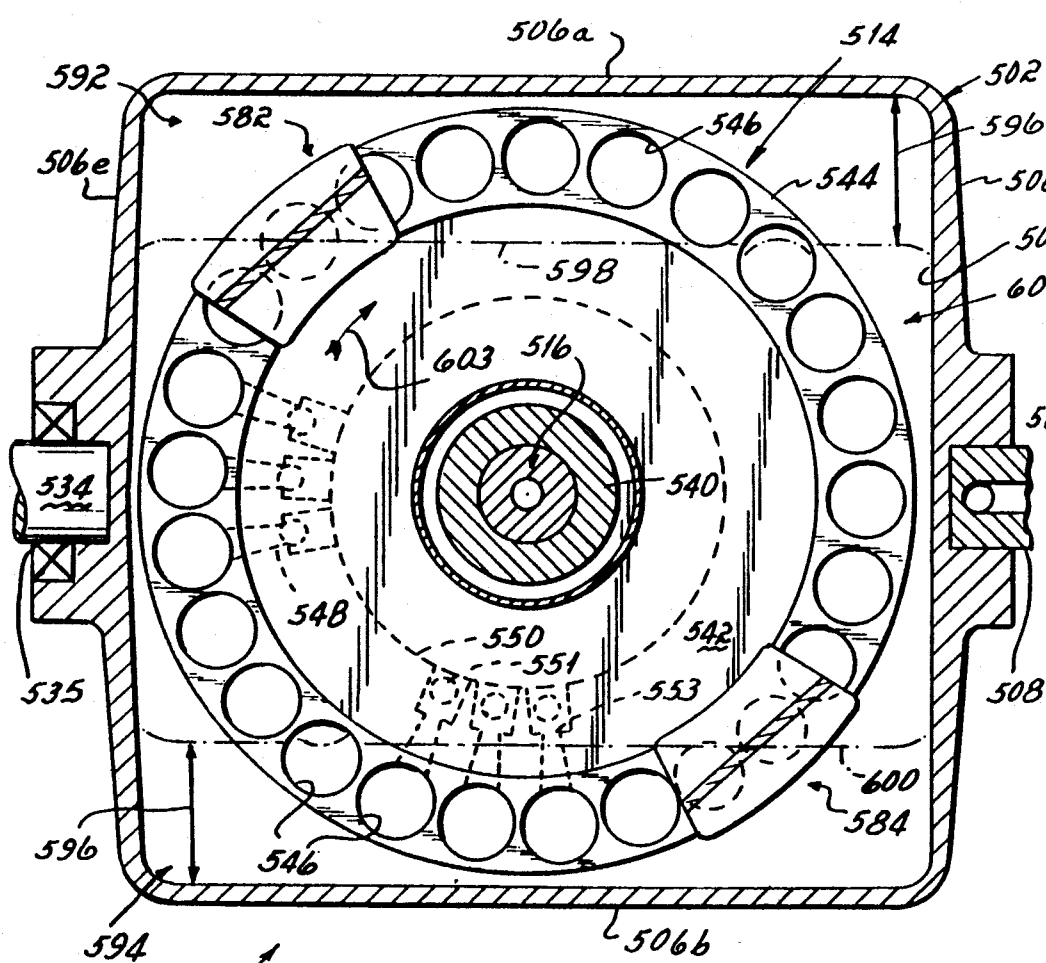
FIG. 14 is a cross sectional view taken generally along line 14—14 of FIG. 13.

Referring now to FIGS. 13–15, a still further embodiment of a pump 500 of this invention is illustrated. The pump 500 comprises a pressure chamber 502 having a hollow interior 504 defined by a top wall **506*a*, bottom wall 506*b*, side walls 506*c, d* and end walls 506*e, f*. The pump, side wall 506*f* is connected to the output shaft 508 of a motor 510 which rotates the chamber 502 about a first axis 512**.

A pumping unit 514, described in more detail below, is mounted on a shaft 516 within the interior 504 of chamber 502. Opposite ends of shaft 516 are carried in bearings **518*a*, 518*b* mounted to the chamber wall, 506*c*, 506*d*, and an outer end 520 of shaft 516 protrudes from one of the bearings 518 and is fixed to a gear 522. This gear 522 meshes with the gear teeth 524 at one end of a rod 526. The rod 526 is carried by a bearing 527 fixed to the chamber side wall 506*d*, and is connected to a timing pulley 528. The timing pulley 528 is drivingly connected by a timing belt 530 to a drive pulley 532 mounted at one end of a shaft 534 rotatably carried in a bearing 535 fixed to chamber end wall 506*e*. Preferably, the shaft 534, also journalled in a standard 537, is driven by a motor 536, shown schematically in FIG. 14, thus completing a drive train through the pulleys 528, 532 and timing belt 530 to the drive rod 526 and shaft 516. This drive train is effective to rotate the pumping unit 514 within the interior 504 of chamber 502 about a second axis 538 which is substantially perpendicular to the first axis 512 about which the chamber 502 is rotated as described above. In an alternative embodiment, the motor 536 is eliminated and sun drive pulley 532 is affixed to the standard 537 such that rotation of the chamber 502 by operation of motor 510 causes the drive pulley 528** to rotate.

With reference to FIGS. 14 and 15, the pumping unit 514 and interior 504 of chamber 502 are illustrated in detail. The pumping unit 514 comprises a hollow hub 540 which is fixedly connected to the outer surface of the shaft 516. The hub 540 is connected by a web 542 to a circular ring 544 formed with a plurality of circumferentially spaced apertures 546. Each of the apertures 546 is connected by a transfer passageway 548 formed in the web 542 to an annular chamber 550 formed in the hub 540 and web 542. Preferably, a one-way valve is positioned within each transfer passageway 548 including a retainer 549 and a ball 551 movable relative to a seat 553 formed in the passageway 548. The chamber 550, in turn, is connected to the inlet 552 of a discharge passageway 554 formed in the shaft 516. The discharge passageway 554 has an outlet at the inner end 558 of shaft 516 which communicates with an air outlet line 560 formed in a cap 562 carried by a cylindrical protrusion 564 integrally formed in the side wall **506*c* of chamber 502. Preferably, a seal 565 is interposed between the cap 562 and the inner end 558 of shaft 516** to prevent the leakage of air therebetween.

Opposite ends of the hub 540 are carried by mounting plates 568 and 570 which are located adjacent the bearings **518*a* and 518*b*, respectively. Mounting plate 570 is preferably formed in a cup shape with a tapered wall 572 which overlies radial passageways or bores 574 formed in the hub 540. The wall 572 has notches 573 around its inner end. The bores 574 are connected to an inlet passageway 576 formed in the righthand side shaft 516 as viewed in FIG. 15, which includes an air inlet 578 located at the outer end 520 of shaft 516 and an outlet 580 communicating with the bores 574 in the hub 540 and notches 573 of key-shaped plate 570**.

In the presently preferred embodiment, two pairs of opposed, air retention seals 582 and 584 are fixed by separate, resilient mounts 586 to the chamber 502. Only the air retention seals 584 are shown in detail in the FIGS. 14 and 15, it being understood that seals 582 are identical in structure and function. As viewed in FIG. 15, an air retention seal 584*a* is fixed to side walls 506*c* by mount 586 on one side of the circular ring 544 of pumping unit 514, and an air retention seal 584*b* is fixed by mount 586 to side wall 506*d* adjacent the opposite side of circular ring 544. The retention seals 584*a, b* are positioned to sealingly engage opposite faces of the circular ring 544 to sequentially close each aperture 546 therein, for purposes to become apparent below. As shown in FIG. 14, the air retention seals 582 are preferably located at one corner of the interior 504 of chamber 502, whereas the air retention plates 584 are located at the opposite corner of the chamber 502.

The operation of the pump 500 of this embodiment is as follows. Unlike the previously described liquid mass embodiments, the interior 504 of chamber 502 is only partially filled with a liquid or semi-liquid material. In response to the application of a centrifugal force applied by rotation of chamber 502 about the first axis 512, the liquid mass is thrust radially outwardly against the top and bottom walls 506*a, b* of chamber 502 forming a liquid mass or body 592 along top wall 506*a* and a liquid mass or body 594 along bottom wall 506*b*. Each of these liquid bodies 592, 594 has a predetermined depth dimension 596 and inwardly facing surfaces 598 and 600, respectively. Preferably, a passageway 595 is formed within each of a pair of ribs 597, 599 carried by the side walls 506*c* and 506*d*, respectively. These passageways 595 provide a flow path for liquid between the liquid bodies 592, 594 so that substantially the same amount of liquid is carried within each liquid body 592, 594, thus ensuring proper balance of the rotating chamber 502. The area or space between the opposed surfaces 598, 600 of the liquid bodies 592, 594 forms an air cavity 602. Because of the application of centrifugal force, at least one area or zone of greater fluid pressure is formed in each of the liquid bodies 592, 594 because they are furthest from the first axis 512 or neutral axis about which the chamber 502 is rotated. Additionally, at least one area or zone of lesser fluid pressure is formed within the air cavity 602, and such pressure decreases to a minimum level along the first axis 512.

Pumping of a fluid such as air with the pump 500 of this embodiment is obtained by rotating the pumping unit 514 between the air cavity 602 and liquid bodies 592, 594. As viewed in FIGS. 14 and 15, each aperture 546 in the ring 544 of pumping unit 514 travels through the air cavity 602 and then into one of the liquid bodies 592 or 594. In the course of moving through the air cavity 602 in the direction of arrow 603, each aperture 546 becomes filled with air supplied through the inlet passageway 576 of shaft 516. As the apertures 546 in the ring 544 approach one of the liquid bodies 592, 594, the air within the apertures 546 tends to be forced therefrom because of the higher pressure thereat. In order to avoid loss of air from the apertures 546, the air retention seals 582 and 584 are provided to seal each of the apertures 546 and prevent the escape of air therefrom. As viewed in FIG. 14, each pair of air retention seals 582 and 584 are located at the interface between the air cavity 602 and the liquid bodies 592 and 594, respectively. The air retention seals 582 and 584 thus provide a means for retaining the air within the apertures 546 in the transition area between the air cavity 602 and liquid bodies 592, 594.

When each aperture 546 enters either of the liquid bodies 592 or 594, the relatively high pressure therein compresses the air within such aperture 546. This compressed air is directed into the transfer passageway 548 associated with such aperture 546, and overcomes centrifugal force to unseat the ball 551 from its seat 553 within the passageway 548. The pressurized air flows through transfer passageway 548 in web 542 into the annular chamber 550, and from there into the discharge passageway 554 of shaft 516 for transfer to the air outlet line 560. After the air within each aperture 546 has been pressurized within either of the liquid bodies 592 or 594, and then discharged through the web 542, the balls 551 of one-way valves are moved by centrifugal force and air pressure to a closed position against the seats 553 which prevents the passage of liquid within liquid bodies 592, 594 into the web 542. The ring 544 continues to rotate and is moved out of the liquid body 592 or 594 after the air is discharged from apertures 546 so that the apertures 546 are again positioned within the air cavity 602 to receive air in preparation for another pumping operation.

Figure 16:
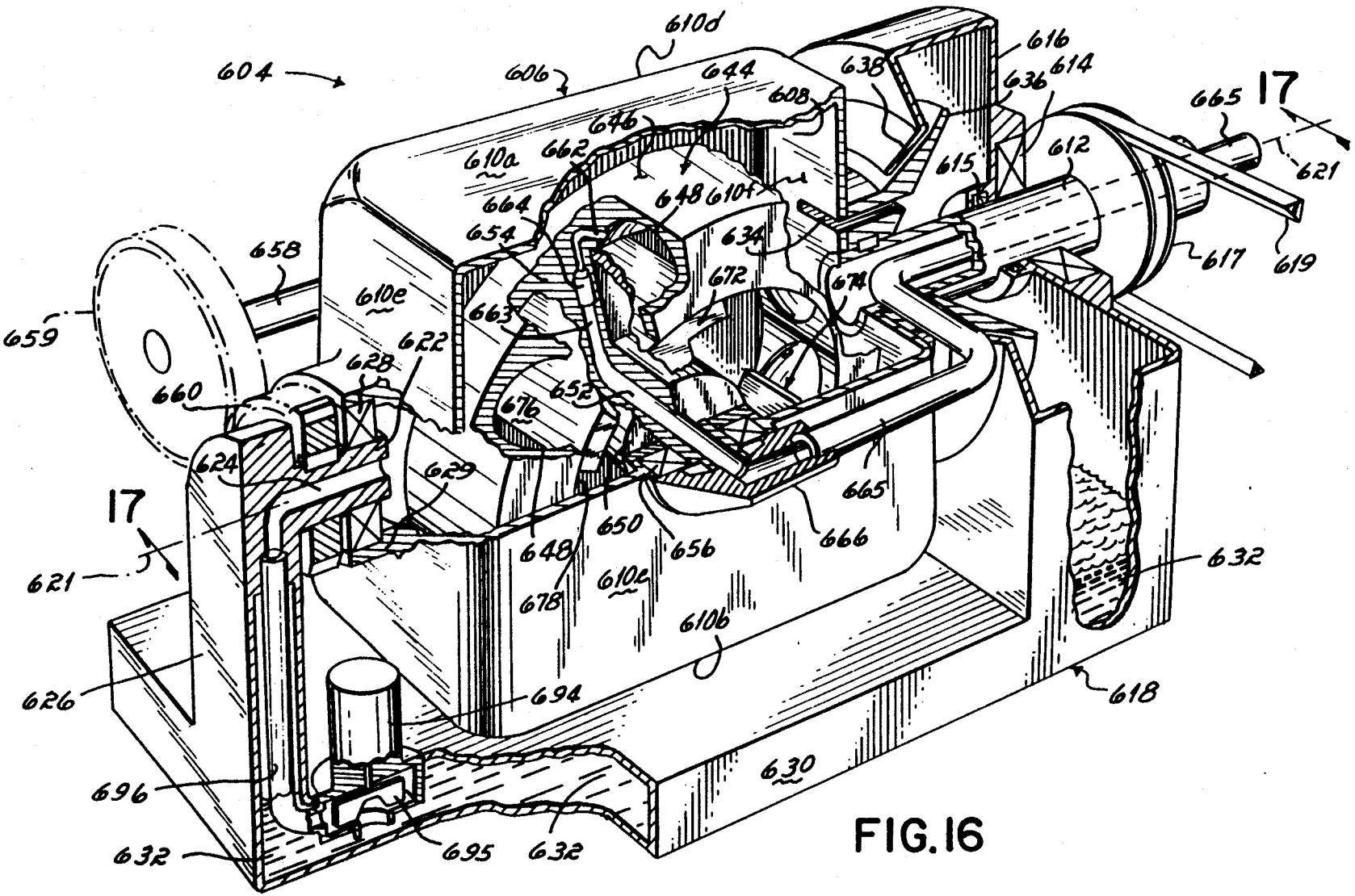
FIG. 16 is a schematic, partially cut-away view of a still further embodiment of this invention.
Figure 17:
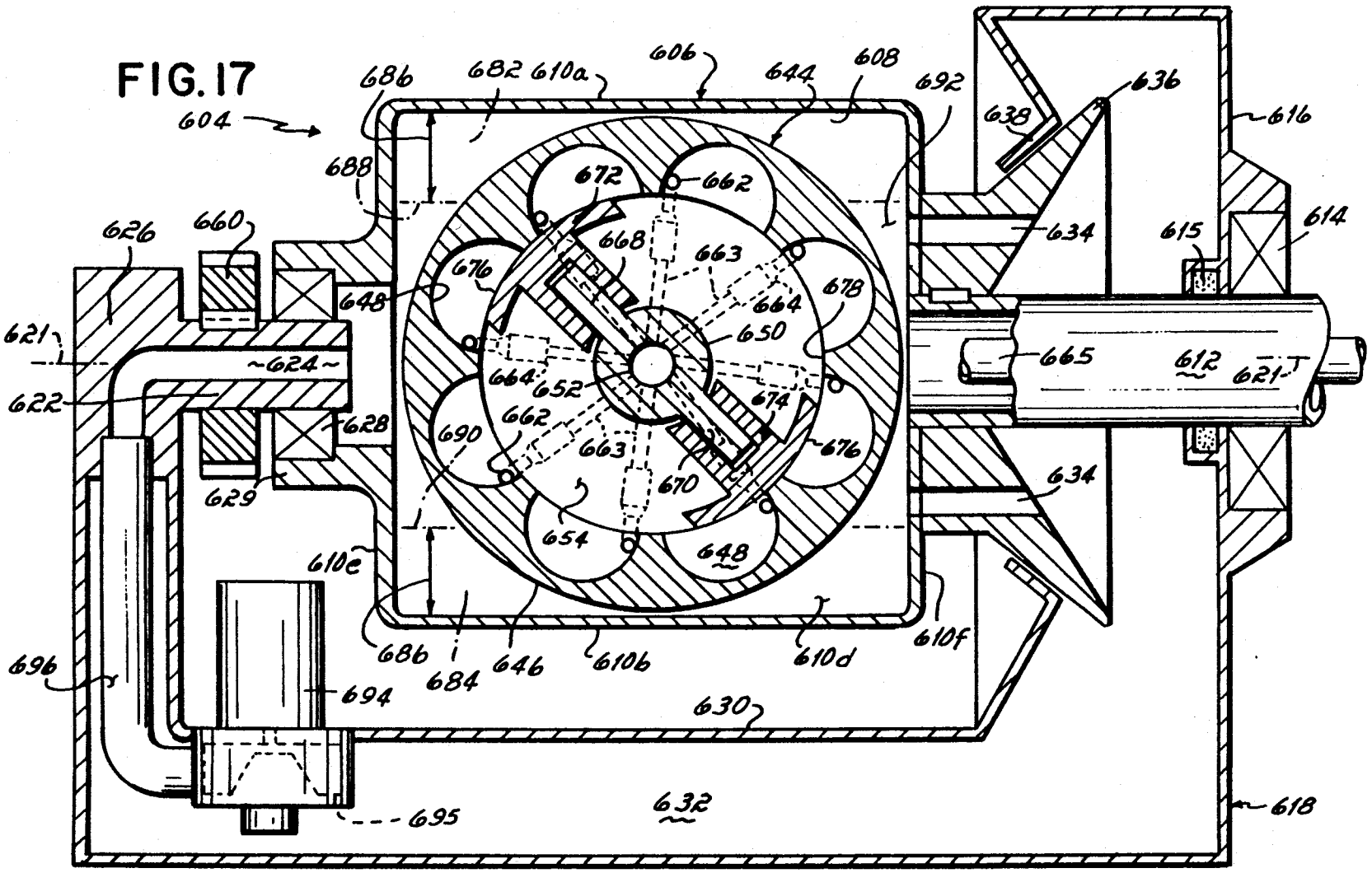
FIG. 17 is a cross sectional view taken generally along line 17—17 of FIG. 16.

Referring now to FIGS. 16 and 17, a further embodiment of a pump 604 of this invention is illustrated which is similar in many respects to the pump 500 of FIGS. 13–15. As in FIGS. 13–15, the pump 604 of this embodiment includes a pressure chamber 606 which is only partially filled with a liquid or semi-liquid material instead of being substantially completely filled as in the previously described mass embodiments of this invention. In the presently preferred embodiment, the pressure chamber 606 comprises a hollow interior 608 defined by a top wall 610*a*, bottom wall 610*b*, front wall 610*c*, back wall 610*d* and end walls 610*e, f*. A hollow drive shaft 612 is keyed to or integrally formed on one side of chamber 606, and is carried within a bearing 614 mounted to an upstanding side support 616 of a support frame 618. Preferably, a seal 615 is carried by the side support 616 in engagement with drive shaft 612 to create a fluid-tight seal therebetween. The drive shaft 612 mounts a V-belt pulley 617 which is drivingly connected to the output of a motor (not shown) by a V-belt 619, for rotation of the pressure chamber 606 about a first axis 621.

The opposite side of pressure chamber 606 includes a stub shaft 622 having a bore 624 which communicates with the chamber interior 608. The stub shaft 622 is integrally formed at the top of a second upstanding side support 626 of frame 618 and is carried by a bearing 628 mounted within a flange 629 formed in the end wall 610*e* of pressure chamber 606. The side support 626 is hollow and is connected to the hollow base 630 of frame 618 which, together with the opposite side support 616, define a reservoir 632 for the collection of liquid escaping from chamber 606, as described below. The reservoir 632 receives liquid from the chamber interior 608 through a pair of axial slots 634 formed in a radially outwardly tapering flange 636 connected to the side wall 610*f* of chamber 606. This flange 636 is received within a mating seat 638 formed in the side support 616 of frame 618.

The pump 604 also includes a pumping unit 644 which comprises an outer ring 646 formed with a plurality of circumferentially spaced recesses 648, a central hub 650 formed with a throughbore 652 and a plate 654 extending between the hub 650 and the outer ring 646.

One end of the hub 650 is carried in a bearing 656 mounted to the front wall 610*c* of pressure chamber 606, and the opposite end of hub 650 is drivingly connected to a shaft 658 mounted to a gear 659. This gear 659, in turn, is drivingly connected to a sun gear 660 fixedly mounted to the stub shaft 622. Rotation of the pressure chamber 606 about axis 621, as described above, causes the gear 659 to orbit around gear 660, which, in turn drives the shaft 658 and hub 650 so that the pumping unit 644 rotates within the pressure chamber 606 about a second axis which is substantially perpendicular to the first axis 621.

In the presently preferred embodiment, a port 662 is formed in the outer ring 646 at each recess 648 and these ports 662 are each connected to the throughbore 652 in hub 650 by a separate connector passage 663 formed in the plate 654. A one-way valve 664 is carried in each connector passage 663. As shown in FIG. 16, the throughbore 652 of hub 650 communicates with a fluid outlet tube 665 mounted at one end to a holder 666 formed in the front wall 610*c* of pressure chamber 606. The outlet tube 665 extends from the throughbore 652 of hub 650 into the interior of hollow drive shaft 612 and then outwardly to a point where the fluid being pumped can be discharged, as described below.

As best shown in FIG. 17, the hub 650 is formed with a pair of radially outwardly extending guides 668 and 670 which are substantially square in cross section. Each guide 668, 670 mounts a sealing member 672 and 674, respectively, which are slidable therealong toward and away from the outer ring 646 of pumping unit 644. As viewed in FIG. 17, and discussed in more detail below, with the sealing members 672 and 674 in an extended position, the arcuate, outer faces 676 thereof sealingly engage a cylindrical-shaped rim 678 formed in the outer ring 646 defined by the peripheral edge of each recess 648 therein.

The operation of pump 604 proceeds as follows. In response to rotation of the drive shaft 612, the pressure chamber 606 is rotated about first axis 621 causing the liquid or semi-liquid material which partially fills the chamber interior 608 to be thrust radially outwardly against the top and bottom walls 610*a, b* of chamber 606 forming a liquid mass or body 682 along a top wall 610*a* and a liquid mass or body 684 along the bottom wall 610*b*. Each of these liquid bodies 682, 684 has a predetermined depth dimension 686 and inwardly facing surfaces 688 and 690, respectively. The area or space between the opposed surfaces 688, 690 of the liquid bodies 682 and 684 forms an air cavity 692. Because of the application of centrifugal force, at least one area or zone of greater fluid pressure is formed in each of the liquid bodies 682 and 684 while at least one area or zone of lesser fluid pressure is formed within the air cavity 692.

Pumping of a fluid such as air with the pump 604 of this embodiment is obtained by rotating the pumping unit 644 between the air cavity 692 and liquid bodies 682, 684 about an axis perpendicular to axis 621. As viewed in FIGS. 16 and 17, air is introduced into the air cavity 692 through the hollow drive shaft 612 in the space surrounding the air discharge tube 665. Each recess 648 in the pumping unit 644 receives a quantity of this air within the air cavity 692, and then transfers such air from the air cavity 692 toward one of the liquid bodies 682 or 684. As each recess 648 approaches one of the liquid bodies 682, 684, the air within the recess 648 tends to be forced therefrom because of the higher pressure within the liquid bodies 682, 684. In order to avoid loss of air from the recesses 648, the sealing members 672 and 674 are thrust radially outwardly along guides 668 and 670 by operation of centrifugal force, and the outer face 676 of each sealing member 672, 674 sealingly engages the cylindrical rim 678 of one of the recesses 648 in the outer ring 646. As a result, the air within each recess 646 is retained therein as the outer ring 646 of pumping unit 644 is rotated through the liquid bodies 682 and 684. Once pressurized, the air is directed from each recess 648 through a port 662, past the one-way valve 664 in the associated connector passage 663, and then into the throughbore 652 formed in hub 650. As shown in FIG. 16, the pressurized air is expelled from the hub 650 into the air discharge tube 665 which carries it outwardly from the pump 604.

One additional feature of the pump 604 of this embodiment is the provision of structure for recovering liquid or semi-liquid material which escapes out of either of the liquid bodies 682 or 684 in the course of movement of the pumping unit 644 therethrough. It is contemplated that at least some of the liquid material within the liquid bodies 682, 684 may escape in the form of a foam, i.e., a mixture of air and liquid, as the pumping unit 644 passes through the liquid bodies 682, 684 and then continues outwardly therefrom into air cavity 692. The structure for recirculating the liquid material includes the reservoir 632 formed in the side support 616 and base 630 of frame 618, and a recirculation pump 694 having a pump impeller 695. The pump 694 is mounted to the base 630 and its impeller 695 extends into the reservoir 632. A recirculation tube 696 is connected to the exhaust side of pump 694 and extends upwardly through side support 626 of frame 618 into communication with the bore 624 in stub shaft 622.

As mentioned above, in the course of rotation of the pumping unit 644 between the air cavity 692 and liquid bodies 682, 684, at least some liquid or semi-liquid material can be lost from the liquid bodies 682, 684 in the form of a foam. Additionally, at least some liquid escapes from the chamber interior 608 during initial start-up of the pump 604. Due to centrifugal force caused by rotation of the pressure chamber 606, the liquid material which escapes the chamber interior 608 flows through the axial slots 634 in the flange 636 of chamber 606 and then falls by gravity into the reservoir 632 within the side support 616 and base 630 of frame 618. The recirculation pump 694 is effective to pump the liquid material from the reservoir 632 through the recirculation tube 696 for discharge into the hollow interior 608 of pressure chamber 606. In this manner, liquid material is constantly returned to the liquid bodies 682, 684 throughout operation of pump 604.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof.

For example, the pumping units 68, 126 and 260 of the various embodiments discussed hereinabove are all similar in operation and could be adapted for use interchangeably in any of the pumps 10, 110 or 192. That is, the pumping unit 68 of pump 110 could be adapted for use in the pump 110 or pump 192 and vice versa.

The pressure-responsive flexible members 74 of FIGS. 1-3, 134 of FIGS. 4 and 5 and 232 of FIGS. 6 and 7 are all preferably formed of an elastomeric material or another material having comparable properties in flexion. It is contemplated that while the flexible members in FIGS. 1-5 were illustrated as a sheet or membrane, other pressure-responsive members could be employed such as a flexible bellows, piston and cylinders and the like which are capable of expansion and retraction under differential pressure.

Each of the embodiments illustrated in the FIGS. employ a main drive to rotate the entire assembly about a first, high speed axis and a secondary drive for rotating the pumping units which is drivingly connected to the main drive. The rate or speed of rotation of the assembly by the main drive controls the pressure of the fluid being pumped, and the rate or speed of rotation of the secondary drive controls the volume of fluid being pumped. It is contemplated that each of the embodiments disclosed could be modified so that the main drive and secondary drive are operative independently of one another, e.g., by separate motors, and that the speed of each drive could be independently variable, so that the pressure and volume of the fluid being pumped could be separately controlled.

Additionally, while the invention was discussed above as performing a positive pumping operation, it is contemplated that the apparatus herein could be employed as a vacuum pump or as a compressor within the teachings herein.

Therefore, it is intended that the invention not be limited to the particular embodiment disclosed as the best mode contemplated for carrying out this invention, but that the invention will include all embodiments falling within the scope of the appended claims.

I claim:

1. Apparatus for pumping fluid, comprising:

a pressure generating mass having a center of gravity;

means for rotating said mass about a first axis so that centrifugal force is applied to said mass, said center of gravity of said mass being positioned at a fixed position relative to said first axis in response to application of centrifugal force and remaining at said fixed position relative to said first axis throughout the application of the centrifugal force;

means for simultaneously rotating a pumping unit about a second axis which is displaced from said first axis of rotation of said mass, said pumping unit having its own center of gravity positioned at a fixed location relative to said second axis upon rotation of said pumping unit, said pumping unit having intake and exhaust means for intaking and exhausting fluid in the course of moving said pumping unit relative to said rotating mass.

2. The apparatus of claim 1 in which said mass is a solid.

3. The apparatus of claim 1 in which said mass is a body of liquid.

4. The apparatus of claim 1 in which said pumping unit is operable to generate a pressure in the exhaust of said pumping unit which is a function of the centrifugal force generated by said mass upon rotation thereof.

5. The apparatus of claim 1 in which said mass is a movable mass.

6. The apparatus of claim 1 in which said mass is a ring having a wall formed with an inner surface and an outer surface.

7. The apparatus of claim 6 in which said intake and exhaust means of said pumping unit are movable along said inner surface of said wall of said ring upon rotation of said pumping unit.

8. The apparatus of claim 6 in which said intake and exhaust means of said pumping unit are movable along said outer surface of said wall of said ring upon rotation of said pumping unit.

9. The apparatus of claim 6 in which said pumping unit is formed with a pumping chamber having an outlet, and said intake and exhaust means of said pumping unit includes a pressure-responsive member in the form of a piston movable within said pumping chamber between an extended position in which said pumping chamber has a maximum volume and a retracted position in which said pumping chamber has a minimum volume.

10. The apparatus of claim 9 in which said piston of each said pumping units includes return means for moving said piston from said retracted position to said extended position within said pumping chamber.

11. The apparatus of claim 10 in which said return means comprises a bracket connected between said piston of one pumping unit and said piston of another pumping unit so that as one of said piston contacts said ring and moves to said retracted position the other of said pistons connected to said bracket is moved to said extended position.

12. The apparatus of claim 6 in which said means for rotating said mass about said first axis comprises:

a support carried by a mounting member;

first drive means for rotating said support relative to a first axis;

a hub connected to said support, said inner surface of said ring being engageable with said hub;

a support shaft connected to said support opposite said hub;

means for rotatably interconnecting said support shaft and said hub;

first drive means for rotating said support frame, hub and ring about said first axis, said ring being subjected to centrifugal force upon rotating about said first axis.

13. The apparatus of claim 12 in which said support includes guides for retaining said ring thereon and for permitting movement of said ring relative to said first axis into contact with said pumping unit.

14. The apparatus of claim 12 in which said hub is formed with a central column having an axial passageway, said central column being formed with spaced inlet ports at one location therealong and spaced outlet ports at another location therealong, said inlet and outlet ports extending into said axial passageway of said central column.

15. The apparatus of claim 14 in which said pumping unit comprises:

a pumping chamber having a top wall, bottom wall and opposite side walls each connected to said central column of said hub, the outer surface of said central column of said hub forming an inner wall of said pumping chamber;

said intake and exhaust means of said pumping unit including:

(i) a piston movable within said pumping chamber along said walls thereof toward and away from said inner wall;

(ii) a roller carried by said piston exteriorly of said pumping chamber, said roller being engageable with said inner surface of said wall of said ring to move said piston inwardly toward said central column of said hub to reduce the volume of said pumping chamber therein and discharge fluid therefrom through said outlet ports formed in said central column of said hub; and (iii) a spring connected between said piston and said inner wall of said pumping chamber, said spring being effective to move said piston outwardly away from said central column of said hub to increase the volume of said pumping chamber and intake fluid therein through said inlet ports formed in said central column of said hub.

16. The apparatus of claim 1 in which said pumping unit comprises:

a hub formed with a bore;

a plate extending radially outwardly from said hub, said plate being formed with a plurality of connector passageways;

a ring carried by said plate, said ring being formed with a plurality of circumferentially spaced, spherical-shaped recesses each connected to one of said connector passageways formed in said plate, said ring being rotatable with said plate and hub about said second axis so that said recesses move relative to said pressure generating mass.

17. The apparatus of claim 16 in which said ring is formed with a port interconnecting each of said apertures therein with a connector passageway in said plate.

18. The apparatus of claim 16 in which an air cavity is formed outside of said pressure generating mass upon rotation thereof, said pumping unit including sealing means located at the interface between said pressure generating mass and said air cavity for retaining air within said recesses in said cylindrical wall, each of said recesses being effective to receive a quantity of air within said air cavity which is retained therein by said sealing means in the course of passage of each said recesses from said air cavity into said pressure generating mass, the air within each said recesses being compressed within said pressure generating mass.

19. The apparatus of claim 18 in which said hub is formed with a pair of radially outwardly extending guides and each of said recesses defines a spherical-shaped rim in said ring, said sealing means comprising a pair of sealing members each slidably carried by one of said guides, each of said sealing members being movable along one of said guides and having an outer face which sealingly engages said rim of each said recesses in said ring as said ring passes from said air cavity into said pressure generating mass.

20. Apparatus for pumping a fluid comprising:

a chamber having a wall defining a hollow interior which is partially filled with a liquid;

means for rotating said chamber about a first axis so that centrifugal force is applied to said liquid, said liquid being forced against said chamber wall forming a liquid mass having a center of gravity, said center of gravity of said liquid mass being positioned at a fixed position relative to said first axis in response to the application of centrifugal force and remaining at said fixed position relative to said first axis throughout the application of the centrifugal force, said interior of said chamber being provided with at least one zone of greater pressure within said liquid mass and at least one zone of lesser pressure outside of said liquid mass in response to the application of the centrifugal force;

means for simultaneously moving a pumping unit relative to said liquid mass and relative to said fixed center of gravity of said liquid mass through said zones of greater and lesser pressure, said pumping unit having intake and exhaust means for intaking fluid in the course of moving to one of said zones of greater pressure and lesser pressure and for exhausting fluid in the course of moving to the other of said zones of greater pressure and lesser pressure.

21. The apparatus of claim 20 in which an air cavity is formed within said hollow interior of said chamber between said liquid mass and said first axis about which said chamber is rotated.

22. The apparatus of claim 21 in which said at least one zone of greater pressure is located within said liquid mass, and said at least one zone of lesser pressure is located within said air cavity.

23. The apparatus of claim 22 in which said pumping unit comprises:

a hub having an internal passageway adapted to communicate with a source of air, said internal passageway having an outlet communicating with said air cavity in said chamber;

an outer ring formed with a plurality of circumferentially spaced apertures, said outer ring being rotatable about a second axis so that said apertures move between said at least one zone of greater pressure within said liquid mass and said at least one zone of lesser pressure within said air cavity;

connecting means for interconnecting said apertures in said ring with said internal passageway in and said hub.

24. The apparatus of claim 23 in which said pumping unit includes sealing means located at the interface between said liquid mass and said air cavity for retaining air within said apertures of said ring, each of said apertures being effective to receive a quantity of air within said air cavity which is retained therein by said sealing means in the course of passage of each said apertures from said air cavity into said liquid mass, the air within each said apertures being compressed within said liquid mass and transferred by said passage means to said hub for discharge from said chamber.

25. The apparatus of claim 24 in which said ring has opposite sides with said apertures extending therebetween, said sealing means comprising a plate mounted to said wall of said chamber on each of said opposite sides of said ring in a position to sealingly engage said ring and cover each of said apertures therein upon movement of said apertures from said air cavity into said liquid mass.

26. The apparatus of claim 23 in which said chamber includes a shaft which mounts said hub for rotation within said chamber, said shaft being formed with a first bore having an inlet communicating with a source of air and an outlet connected to said internal passageway of said hub, said shaft being formed with a second bore connected to said connecting means.

27. The apparatus of claim 23 in which said connecting means comprises at least one arm extending between said ring and said hub, said arm being formed with an internal bore having an inlet at said ring and an outlet at said hub, a one-way valve being carried within said bore to permit the passage of pressurized air from said ring to said hub.

28. The apparatus of claim 20 in which said chamber has first and second opposed walls, a portion of said liquid mass being forced radially outwardly against each of said first and second walls in response to the application of centrifugal force forming a first liquid body along said first wall, a second liquid body along said second wall and an air cavity therebetween.

29. The method of pumping a fluid, comprising:

rotating a pressure generating mass having a center of gravity about a first axis;

subjecting said mass to centrifugal force in the course of rotation about said first axis so that said center of gravity of mass is located at a fixed position relative to said first axis throughout the application of the centrifugal force;

simultaneously rotating a pumping unit about a second axis which is displaced from said first axis of rotation of said pressure generating mass, said pumping unit having its own center of gravity positioned at a fixed location relative to said second axis upon rotation of said pumping unit;

intaking and exhausting fluid by operation of an intake and exhaust means associated with said pumping unit in the course of said pumping unit rotating relative to said rotating, pressure generating mass.

30. The method of claim 29 in which said step of rotating said pressure generating mass comprises rotating a ring having a wall formed with an inner surface and an outer surface about said first axis.

31. The method of claim 30 in which said step of simultaneously rotating said pumping unit comprises moving said intake and exhaust means of said pumping unit along said inner surface of said wall of said ring upon rotation of said pumping unit.

32. The method of claim 30 in which said step of moving said pumping unit comprises moving said intake and exhaust means of said pumping unit along said outer surface of said wall of said ring upon rotation of said pumping unit.

* * * * *